US007846020B2

(12) United States Patent
Walker et al.

(10) Patent No.: US 7,846,020 B2
(45) Date of Patent: Dec. 7, 2010

(54) PROBLEM GAMBLING DETECTION IN TABLETOP GAMES

(75) Inventors: Jay S. Walker, Ridgefield, CT (US); Daniel E. Tedesco, Shelton, CT (US); James A. Jorasch, New York, NY (US); Russell P. Sammon, San Francisco, CA (US)

(73) Assignee: Walker Digital, LLC, Stamford, CT (US)

( * ) Notice: Subject to any disclaimer, the term of this patent is extended or adjusted under 35 U.S.C. 154(b) by 1071 days.

(21) Appl. No.: 11/422,756

(22) Filed: Jun. 7, 2006

(65) Prior Publication Data

US 2010/0279765 A9 Nov. 4, 2010

Related U.S. Application Data

(63) Continuation of application No. 11/422,376, filed on Jun. 6, 2006.

(51) Int. Cl.
*A63F 9/24* (2006.01)

(52) U.S. Cl. ..... 463/29

(58) Field of Classification Search ..... 463/29
See application file for complete search history.

(56) References Cited

U.S. PATENT DOCUMENTS

| | | | | |
|---|---|---|---|---|
| 5,166,502 | A | 11/1992 | Rendleman et al. | 235/492 |
| 5,651,548 | A | 7/1997 | French et al. | 273/309 |
| 5,676,376 | A | 10/1997 | Valley | 273/288 |
| 5,735,742 | A | 4/1998 | French | |
| 6,000,696 | A | 6/1999 | Walker et al. | |
| 5,941,769 | A | 8/1999 | Order | 463/12 |
| 6,021,949 | A | 2/2000 | Boiron | 235/492 |
| 6,165,069 | A | 12/2000 | Sines et al. | |
| 6,296,190 | B1 | 10/2001 | Rendleman | 235/492 |
| 6,464,584 | B2 | 10/2002 | Oliver | 463/25 |
| 6,629,890 | B2 | 10/2003 | Johnson | |
| 6,676,517 | B2 | 1/2004 | Beavers | 463/25 |
| 6,889,979 | B2 | 5/2005 | Blaha et al. | 273/149 |
| 6,908,385 | B2 | 6/2005 | Green | |
| 7,011,309 | B2 | 3/2006 | Soltys et al. | 273/149 |

(Continued)

FOREIGN PATENT DOCUMENTS

WO WO 02/62437 A2 2/2002

(Continued)

OTHER PUBLICATIONS

Sanders, Peter, "Casinos Bet on Radio-ID Gambling Chips", The Wall Street Journal, May 13, 2005, 3 pp.

(Continued)

*Primary Examiner*—Corbett B Coburn
(74) *Attorney, Agent, or Firm*—Fincham Downs, LLC; Magdalena M. Fincham

(57) ABSTRACT

A gaming establishment may determine the existence of problem gamblers within its halls by monitoring player behavior with one or more sensors from an array of sensors. The player's behavior is then compared to normal behavior and/or problem gambling behavior to determine if the player is potentially a problem gambler. Behavior patterns that may be tracked are player movement, player betting patterns, facial expressions, physical clues, nonverbal clues, and the like.

6 Claims, 29 Drawing Sheets

U.S. PATENT DOCUMENTS

| | | | | |
|---|---|---|---|---|
| 7,016,876 | B1 | 3/2006 | Lanier et al. | |
| 7,029,009 | B2 | 4/2006 | Grauzer et al. | 273/149 |
| 2002/0111210 | A1 | 8/2002 | Luciano, Jr. et al. | 463/29 |
| 2002/0123376 | A1 | 9/2002 | Walker et al. | |
| 2002/0138461 | A1 | 9/2002 | Sinclair et al. | |
| 2002/0147042 | A1 | 10/2002 | Vuong et al. | 463/40 |
| 2003/0003997 | A1 | 1/2003 | Vuong et al. | 463/42 |
| 2003/0022719 | A1 | 1/2003 | Donald et al. | |
| 2003/0190944 | A1* | 10/2003 | Manfredi et al. | 463/20 |
| 2004/0106449 | A1 | 6/2004 | Walker et al. | |
| 2004/0207156 | A1 | 10/2004 | Soltys et al. | 273/292 |
| 2004/0242319 | A1 | 12/2004 | Walker et al. | |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0051955 | A1 | 3/2005 | Schubert et al. | 273/149 |
| 2005/0051965 | A1 | 3/2005 | Gururajan | 273/292 |
| 2005/0054408 | A1 | 3/2005 | Steil et al. | 463/11 |
| 2005/0062226 | A1 | 3/2005 | Schubert et al. | 273/149 |
| 2005/0062227 | A1 | 3/2005 | Grauzer et al. | 273/149 |
| 2005/0113166 | A1 | 5/2005 | Grauzer et al. | |
| 2005/0212214 | A1 | 9/2005 | Pfeiffer et al. | 273/292 |
| 2005/0242500 | A1 | 11/2005 | Downs, III | 273/149 |
| 2006/0063577 | A1 | 3/2006 | Downs, III et al. | 463/11 |
| 2006/0076401 | A1 | 4/2006 | Frerking | 235/380 |
| 2006/0077036 | A1 | 4/2006 | Roemerman et al. | 340/5.61 |

FOREIGN PATENT DOCUMENTS

| | | | |
|---|---|---|---|
| WO | WO 03/060846 | A2 | 7/2003 |

OTHER PUBLICATIONS

Gibert, Alorie "Vegas Casino Bets on RFID",CNET News.com, Feb. 9, 2006, 3 pp.

Stutz, Howard "Problem Gambling Help Seen", Las Vegas Review-Journal, Dec. 7, 2005, 2 pp.

"Problem Gambling Awareness Week", Business Wire, Inc., 2 pp.

Progressive Gaining ITS, Intelligent Table Systems, download date Mar. 6, 2006, 2 pp.

Bloodhound, Shuffle Master, Inc., www.shufflemaster.com/02_eu_products/utility_products/its/bloodhound.asp, download date Apr. 25, 2006, 1 pp.

Bloodhound Blackjack Monitoring System, Increases Baccarat Security, Shuffle Master, Inc., 2 pp.

Intelligent Shoe, Increases Baccarat Game Security, Shuffle Master, Inc., 2 pp.

Intelligent Shoe, Increases Multi-Deck Game Security, Shuffle Master, Inc., 2 pp.

RFID Gaming Chips, Gaming Partners International USA, 12 pp.

Easy Chipper Automatic Chip Sorter, Shuffle Master, Inc., 2 pp.

Nowatzki, Nadine R. and Williams, Robert J. Casino Self-Exclusion Programmes: A Review of the Issues, International Gambling Studies, Jul. 2002, vol. 2, 18 pp.

Tian, Ying-li et al., Real World Real-Time Automatic Recognition of Facial Expressions, IBM T.J. Watson Research Center, 8 pp.

Busso, Carol et al., Analysis of Emotion Recognition Using Facial Expressions, Speech and Multimodal Information, Viterbi School of Engineering, University of Southern California, Los Angeles, 7 pp.

Table Master Multi-Player Platform, Shuffle Master, Inc., 2 pp.

Saturn Interactive Display and Apollo Electronic Roulette Brochure, Zuum Innovative Gaming Systems, 2 pp.

Office Action for U.S. Appl. No. mailed Apr. 15, 2010, 9 pp.

Search Report for PCT Application No. PCT/US06/23522 mailed May 1, 2008, 4 pp.

Written Opinion for PCT Application No. PCT/US06/23522 mailed May 1, 2008, 12 pp.

Written Opinion for PCT Application No. PCT/US05/043595 mailed Apr. 26, 2006, 6 pp.

Final Office Action for U.S. Appl. No. 11/422,376 mailed Sep. 2, 2010, 11 pp.

* cited by examiner

176

| | PLAYER IDENTIFIER 184 | NAME 186 | ADDRESS 188 | PLAYER SINCE 190 | TOTAL WAGERED 192 |
|---|---|---|---|---|---|
| R176-1 | P-000001 | BOB JONES | 15 ELM ST. SPRINGTOWN, NY | 11/20/99 | $1,535.00 |
| R176-2 | P-000002 | MARIA LOPEZ | 35 GUMDROP DR. CAPITAL CITY, CA | 7/28/04 | $168.50 |
| | ... | ... | ... | ... | ... |
| R176-3 | P-106998 | CHARLES WILLIAMS | 140 MAIN ST. PRAIRIEVILLE, ND | 1/15/93 | $19,754.25 |
| R176-4 | P-106999 | KLYE SMITH | 65 BEACH LN. #1 BEACH CITY, NJ | 3/26/98 | $980.10 |

FIG. 13A

| PROBLEM GAMBLER IDENTIFIER 200 | DATE IDENTIFIED 202 | DISPATCHED EVENTS 204 | | CURRENT STATUS 206 |
|---|---|---|---|---|
| P-000001 | 03/03/2005 | 03/03/2005 | EMPLOYEE PASSIVE INTERVENTION | PREVENT WAGERS ≥ $1.00 |
| | | 03/29/2005 | QUESTIONNAIRE AND GAMBLERS ANONYMOUS INFO. OUTPUT | |
| | | 05/01/2005 | EMPLOYEE AGGRESSIVE INTERVENTION | |
|  SMITH, NORA | 06/12/2005 | 06/12/2005 | EMPLOYEE PASSIVE INTERVENTION | CONTINUE LOW-GRADE INTER-VENTION |

180

| | DISPATCHED EVENT IDENTIFIER 208 | EVENT DESCRIPTION 210 | TIME OF DISPATCH 212 |
|---|---|---|---|
| R180-1 | DE-101327910 | EMPLOYEE 6031120 APPROACH PLAYER - PASSIVE INTERVENTION | 07/01/2005 3:22 PM |
| R180-2 | DE-101327911 | EMPLOYEE 7031240 APPROACH PLAYER - AGGRESSIVE INTERVENTION | 07/01/2005 4:17 PM |
| R180-3 | DE-101327912 | OUTPUT MESSAGE M402-11 | 07/01/2005 4:18 PM |
| R180-4 | DE-101327913 | INTERRUPT PLAY | 07/01/2005 4:22 PM |

FIG. 15A 180 (CONT.)

| | TIME OF COMPLETION 214 | PLAYER IDENTIFIER 216 | FEEDBACK 218 |
|---|---|---|---|
| R180-1 | 07/01/2005 3:28 PM | P-791021 | PLAYER FRIENDLY, TOOK A BREAK |
| R180-2 | IN PROGRESS | P-092418 | - |
| R180-3 | 07/01/2005 4:19 PM | P-000433 | PLAYER COMPLETED QUESTIONNAIRE |
| R180-4 | 07/01/2005 4:22 PM | P-905777 | PLAYER LOGGED COMPLAINT, LEFT CASINO |

FIG. 15B

182

| | EVENT IDENTIFIER 220 | EVENT DESCRIPTION 222 | EVENT LEVEL 224 | OUTPUT RULE 226 |
|---|---|---|---|---|
| R182-1 | E-3210 | DISPATCH EMPLOYEE TO OBSERVE PLAYER | 1 | 150 ≥ PROBLEM GAMBLER SCORE ≥ 100 |
| R182-2 | E-5031 | DISPATCH EMPLOYEE TO TALK TO PLAYER ABOUT ISSUES UNRELATED TO PROBLEM GAMBLING | 1 | 175 ≥ PROBLEM GAMBLER SCORE ≥ 151 |
| R182-3 | E-3207 | DISPATCH EMPLOYEE TO TALK TO PLAYER ABOUT ISSUES RELATED TO PROBLEM GAMBLING | 2 | 225 ≥ PROBLEM GAMBLER SCORE ≥ 176 |
| R182-4 | E-7031 | OUTPUT PROBLEM GAMBLER QUESTIONNAIRE | 2 | 275 ≥ PROBLEM GAMBLER SCORE ≥ 226 |
| R182-5 | E-6041 | INTERRUPT PLAY | 3 | PROBLEM GAMBLER SCORE ≥ 276 |

FIG. 16

PROBLEM GAMBLING DETECTION IN TABLETOP GAMES

CROSS REFERENCE TO RELATED APPLICATIONS

This application is a continuation application of U.S. patent application Ser. No. 11/422,376, entitled "Problem Gambling Detection in Tabletop Games", filed Jun. 6, 2006; which is a Continuation-In-Part Application of International Application PCT/US2005/043595, filed 2 Dec. 2005, entitled GAMING SYSTEMS AND APPARATUS FOR DETECTING A SIGNAL INDICATIVE OF A PROBLEM GAMBLER AND DISPATCHING AN EVENT IN RESPONSE THERETO.

U.S. patent application Ser. No. 11/422,376 is incorporated by reference herein in its entirety.

FIELD OF THE INVENTION

The present invention relates to detecting problem gamblers in a tabletop game gambling environment.

BRIEF DESCRIPTION OF THE DRAWINGS

FIGS. 13A & 13B illustrate a player database according to one embodiment of the present invention;

FIGS. 15A & 15B illustrate a dispatched events database according to one embodiment of the present invention;

FIG. 16 illustrates an available events database according to one embodiment of the present invention;

DETAILED DESCRIPTION OF THE INVENTION

For many people, gambling is a fun and relaxing way with which to spend time. Not only does gambling provide people with a pleasurable and potentially profitable leisure activity, but also gambling contributes to the financial well being of many societal segments. Lotteries act as voluntary taxes and have helped fund schools and other academic institutions in many jurisdictions. Likewise, the gambling industry directly provides jobs for casino employees including dealers, floor managers, machine technicians, hotel clerks, cleaning personnel, bellhops, and the like. Gambling can, and in many locations, does create its own tourism industry, which in turn creates more jobs as establishments grow to provide ancillary services for the tourists including restaurants and retail outlets, all of which must be staffed. As these establishments grow, support establishments must grow to provide day-to-day services for the employees serving the tourist trade. Thus, groceries, dry cleaners, car washes, day care facilities, and the like all spring up to serve those who serve the tourists.

However, gambling has been denigrated by certain societal elements, in part because a few players are incapable of recognizing (or are not responsible enough to recognize) when to stop gambling. Such players may spend money they cannot afford on wagering games. These players may gamble to such an extent that they lose their jobs, destroy their marriages, and become a burden on society. Such problem gamblers form a small, but readily visible, segment of the gambling culture.

Embodiments of the present invention focus on detecting problem gambling for tabletop style games. In particular, embodiments of the present invention use one or more sensors (e.g., from an array of sensors) to detect behavior of patrons within a gaming establishment. These behavior patterns are compared to behavior patterns that may be typical of problem gambling and/or behavior patterns of non-problem gambling to determine if the patron might be a problem gambler. Once a determination has been made about a patron's problem gambling status or potential problem gambler status, an event may be triggered. For example, an alert may be generated so that gaming establishment personnel may take further action as appropriate. In a particularly contemplated embodiment, a patron is initially identified as a potential problem gambler and further information is specifically elicited for that particular patron before a decision is made as to whether the patron is a problem gambler.

Before addressing the methodology of the present invention, a discussion of the gaming environment and the sensors that may be used by various embodiments of the present invention is provided. A discussion of the methodology of various embodiments of the present invention begins with reference to FIG. 18.

Figure 1:
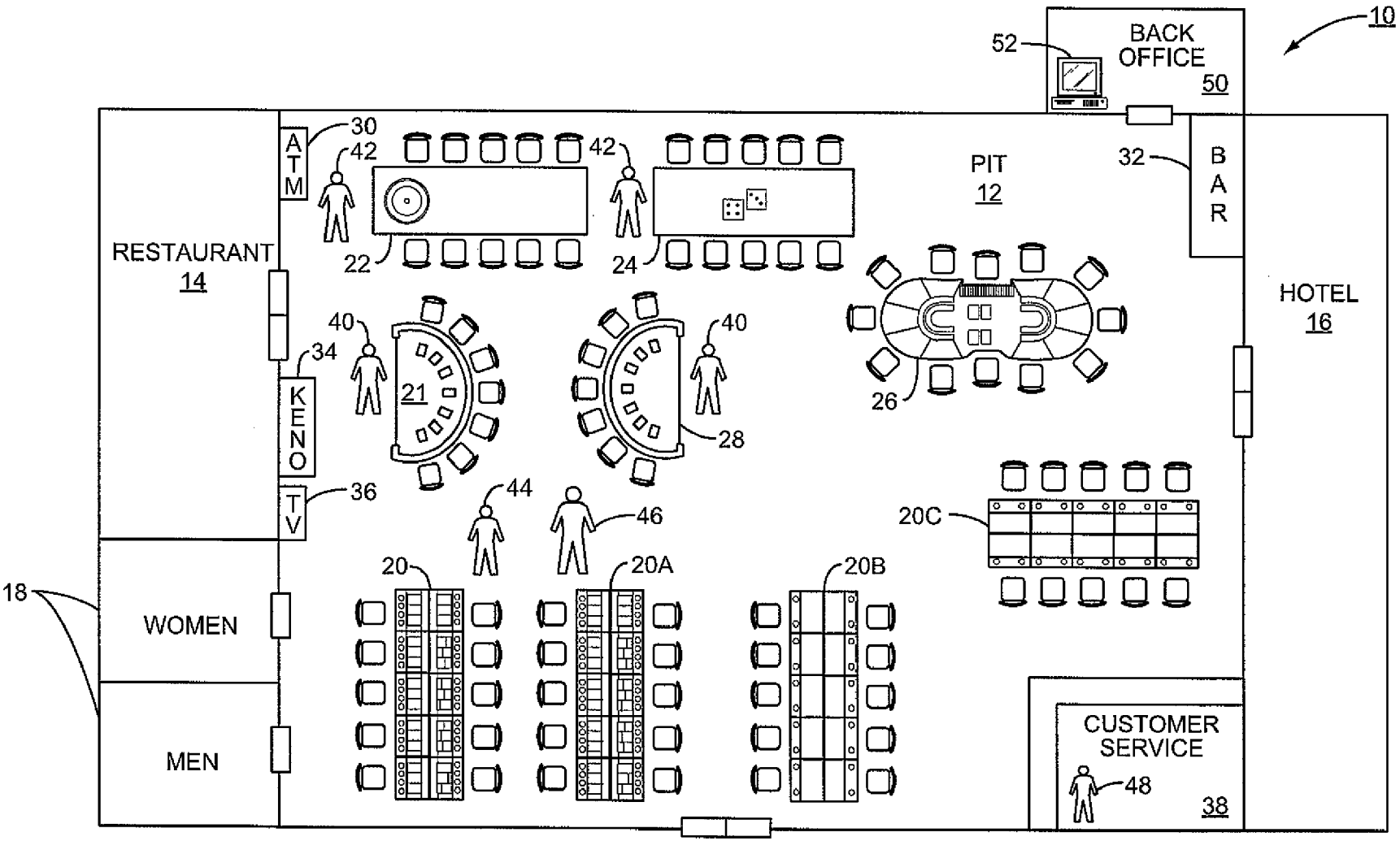
FIG. 1 illustrates a gaming establishment according to one embodiment of the present invention.

Tabletop games are typically played in a gaming establishment such as a casino, the gambling area of a cruise ship, or other physical locale. An exemplary gaming establishment 10 is illustrated in FIG. 1 and may include a pit 12, a restaurant 14, and a hotel 16. Additionally, restrooms 18 may be positioned in close proximity to the pit 12. The pit 12 may include numerous games of chance, including automated machines and tabletop games. The automated machines may be arranged in banks 20 and include slot machines, video slot machines, video poker machines, video keno machines, video blackjack machines, video roulette machines, video bingo machines, pachinko machines, video lottery terminals, and the like. For the purposes of the present discussion bank 20A is a bank of mechanical reel slot machines; bank 20B is a bank of video poker machines; and bank 20C is a bank of video blackjack machines; all collectively referred to herein as banks 20.

The tabletop gaming portion of pit 12 may include a blackjack table 21, a roulette table 22, a craps table 24, a baccarat table 26, a Caribbean Stud table 28, and the like as needed or desired. Other amenities and games may be located in pit 12 including an automated teller machine (ATM) 30, a bar 32, a keno booth 34 with a keno monitor 36, and a customer service booth 38. Customer service booth 38 may include a cashier that sells chips, provides cash outs for cashless receipts, and performs other general customer service functions.

Personnel such as dealers 40, croupiers 42, floor men 44, pit boss 46, and customer service facilitator 48 may be positioned throughout the pit 12 running games, addressing customer complaints, providing comps, and otherwise making sure that the gaming operations run smoothly within the gaming establishment 10. While dealers 40 and croupiers 42 are expected to be the primary source of some of the information used by embodiments of the present invention, as used herein, the term "personnel" includes all such individuals and auxiliary personnel such as a hotel desk clerk, maitre d', waitpeople, and the like unless otherwise specified.

Gaming establishment 10 may also include a back office 50 that may include a site controller 52 that controls operations within the gaming establishment 10. Exemplary functions of the site controller 52 include, but are not limited to: a slot server, a merchant point of sale, a point of sale server, an inventory server, a reservations server for the hotel 16, the communicative link to a credit card processor's computer network, and the like. To this end, the site controller 52 may be communicatively coupled to various elements within the gaming establishment 10 through any communication network using any communication protocol, although a secure communication network may be needed to prevent unauthorized access to the information thereon. A more detailed explanation of site controller 52 is provided with reference to FIG. 12.

While an exemplary gaming establishment layout is provided, it should be appreciated that the location, number, type, and nature of the games may be varied as needed or desired without departing from the scope of the present invention.

In normal operation, patrons enter the gaming establishment 10 and gamble. Some patrons will gravitate to the automated machines within banks 20. Other patrons will head to the tabletop games for their gambling experience. Embodiments of the present invention are directed to detecting potential problem gamblers in tabletop games. To this end, embodiments of the present invention provide a variety of sensors positioned in and around the pit 12 with which to monitor player behavior and player attributes from which potential problem gambling may be detected. One or more of the following sensors may be used alone or in combination with other sensors to implement various embodiments of the present invention.

Figure 2:
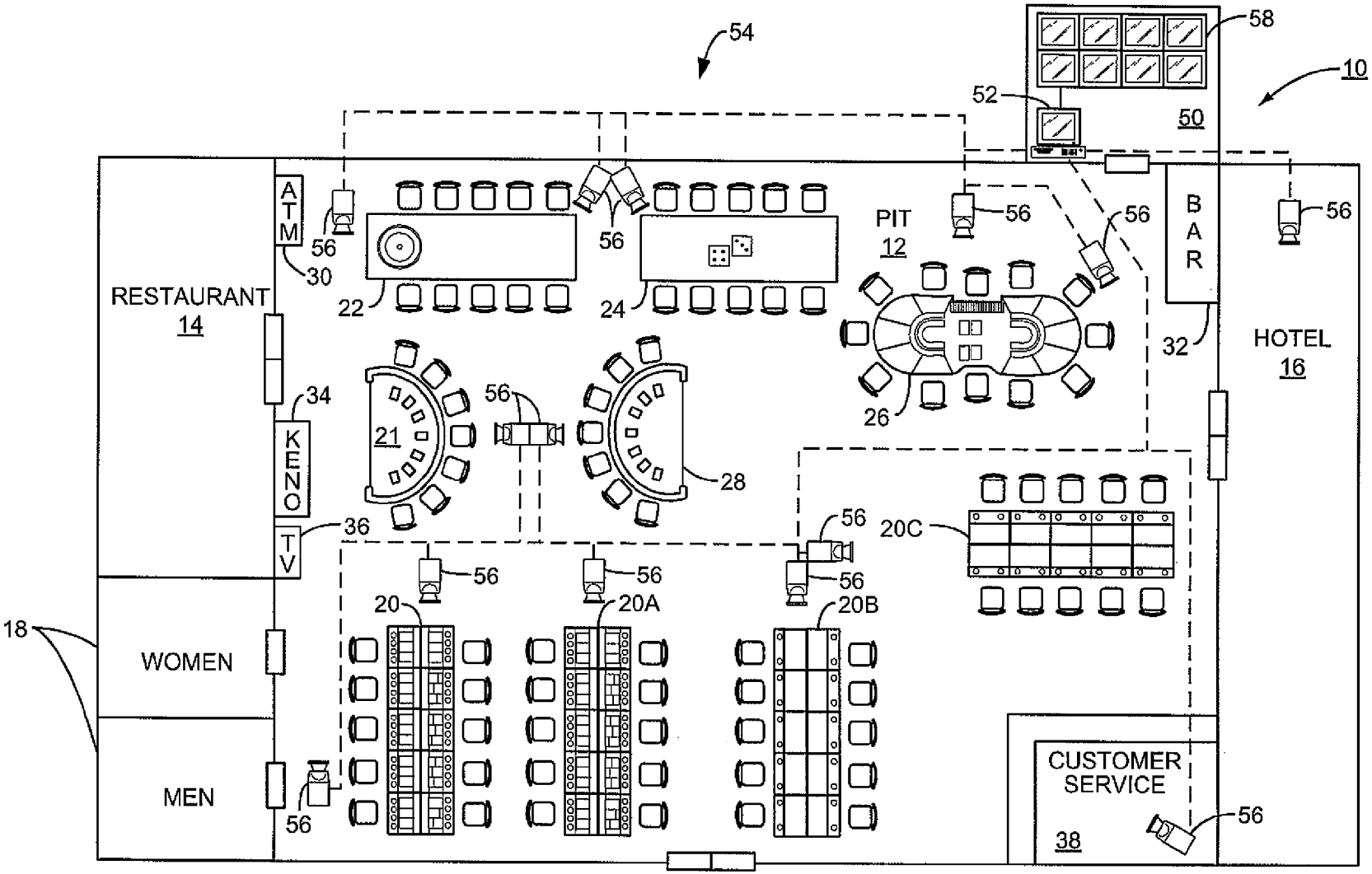
FIG. 2 illustrates a camera network within the gaming establishment according to one embodiment of the present invention.

A first type of sensor is a camera network 54 illustrated in FIG. 2. Individual cameras 56 may be positioned over each game within the pit 12. Additional cameras 56 may cover the ATM 30, the bar 32, the customer service counter 36, and any open space within the pit 12. The cameras 56 may be positioned in the ceiling, obscured amidst the lighting elements and HVAC ductwork. Alternatively, the cameras 56 may be positioned in the floor looking up, on the walls, or other locations so as to provide constant video surveillance of the pit 12. Note that it is possible that the camera network 54 may be extended into the ancillary portions of the gaming establishment 10 such as the restaurant 14, the public areas of the hotel 16 and the like. It is possible that the camera network 54 may even extend into the restrooms 18 and the individual guest rooms within the hotel 16, although privacy concerns may outweigh any problem gambling detection benefit that might be achieved from such placement.

Each of the cameras 56 is communicatively coupled to a controller, such as site controller 52 of the back office 50. The back office 50 may have one or more video monitors 58 that allow video feeds from any of the cameras 56 to be displayed and viewed by authorized or appropriate gaming establishment personnel. The cameras 56 may communicate with the site controller 52 through wirebased or wireless communication networks as needed or desired. The cameras 56 may operate in the visible portion of the electromagnetic spectrum (~176-750 nm), the near infrared (~750-1200 nm), medium and far infrared (~4-14 microns), the ultraviolet (~10-176 nm), or other portion of the electromagnetic spectrum as needed or desired. Alternatively, the cameras 56 may be thermal infrared cameras such as the TIR1 or TIR2 sold by Maxmax of 220 Broad Street, Carlstadt, N.J. 07072, which allow the detection of specific heat levels within the viewing field.

Note that in some embodiments, the cameras 56 may be fixed, but in other embodiments, the cameras 56 may be associated with a motor and may be moved so that different areas within the pit 12 may come under surveillance. Alternatively, some cameras 56 may sweep through an arc or other pattern in normal operation, but may be directed to focus on particular spots within their field of movement as needed or desired. Wide angle and zoom functions may also be enabled within the cameras 56 as needed or desired.

The camera network 54 may be associated with software that detects and analyzes facial expressions or other physical movement of players so as to ascribe emotion thereto. Certain emotions and facial expressions (or lack thereof) may be indicative of problem gambling, including, but not limited to: lack of sleep, inappropriate happiness, inappropriate anger and/or inappropriate sadness. The software may be stored in the site controller 52, in a server dedicated to the camera network 54 (not shown), or other computer as needed or desired. Exemplary work on facial expression and emotions tied thereto can be found in www.sail.usc.edu/publications/ICMI2004_Busso.pdf and www.research.ibm.com/peoplevision/PETS2003.pdf, both of which are hereby incorporated by reference in their entireties, and copies of which are concurrently filed in an Information Disclosure Statement. Note that in some embodiments, the cameras 56 are placed in a location where a player is forced to look, such as in or on the blackjack table 21 near the dealer's cards. Such placement may facilitate capture of straight-on images of a player's face to facilitate automated facial expression analysis.

Figure 3:
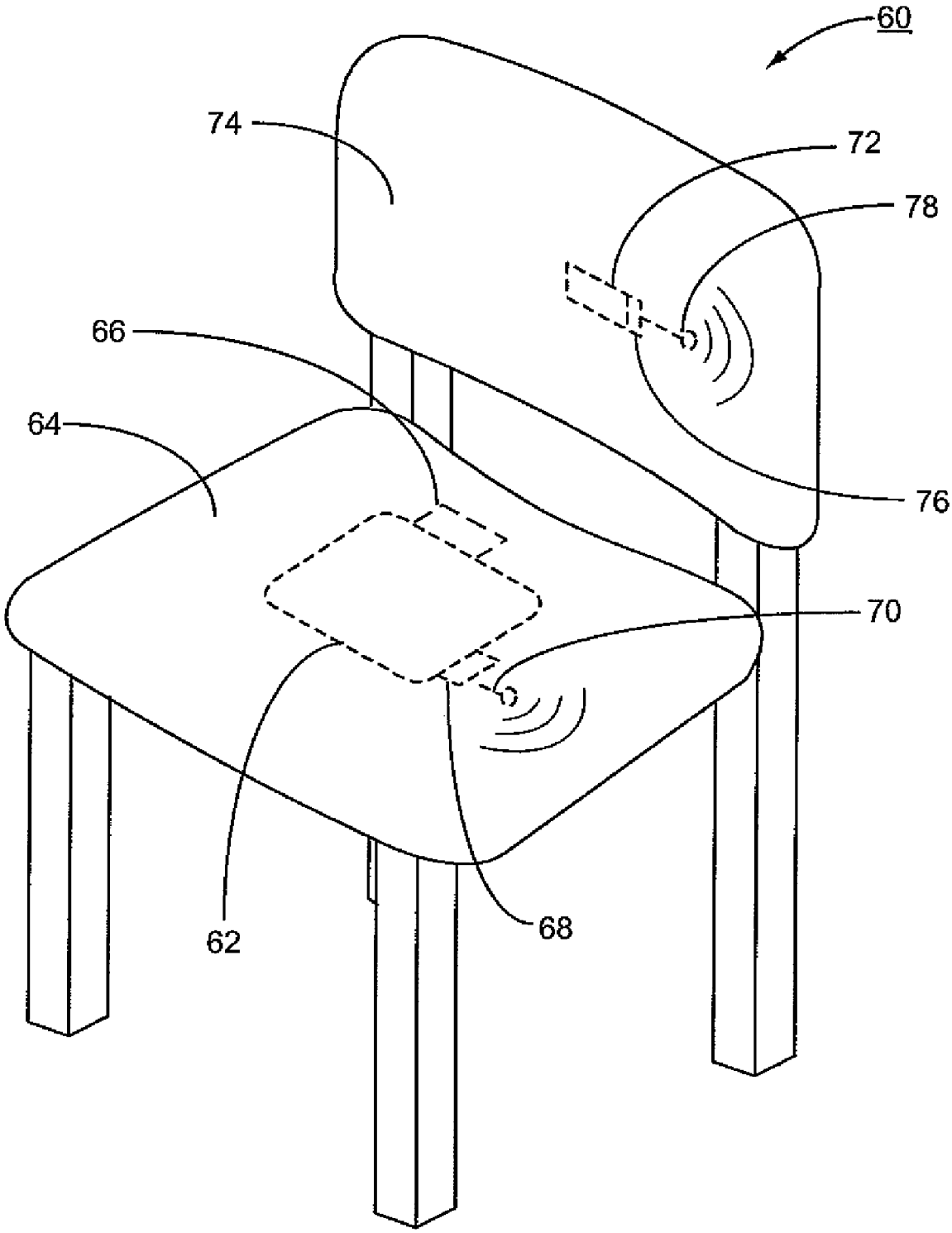
FIG. 3 illustrates a chair with patron sensors according to one embodiment of the present invention.

More sensors may be associated with the chairs within the gaming establishment 10. For example, as illustrated in FIG. 3, a chair 60 may include a pressure sensor 62 in the seat 64 of the chair. Alternatively or additionally, a thermal sensor 66 may be positioned in the seat 64. When a patron sits in the chair 60, the weight of the patron is detected by the pressure sensor 62 and the body heat of the patron is detected by the thermal sensor 66. The pressure sensor 62 and/or the thermal sensor 66 are communicatively coupled to a wireless transmitter 68, which transmits information collected by the sensors through an antenna 70 to the site controller 52. Pressure sensor 62 may further be adapted to detect vibrations. For example, if a patron is bouncing in her chair, the pressure sensor 62 may detect this behavior. Likewise, if the patron is drumming her fingers on the chair 60 or tapping her foot, it is possible that the pressure sensor 62 may detect this behavior. Alternatively, a separate vibration sensor (not shown) may be positioned in the chair 60 and use the transmitter 68 to communicate to the site controller 52.

In an alternate embodiment, a thermal sensor 72 may be positioned in the seat back 74 of the chair 60 and communicate with the site controller 52 through a transmitter 76 and antenna 78. A pressure sensor (not shown) could also be positioned in the seat back 74. Disadvantageously, some patrons may not lean against the seat back 74, and thus this positioning may not be optimal for detecting all patrons. As an alternative to the transmitters 68 and 76, the sensors 62, 66, 72 could alternatively be communicatively coupled to the site controller 52 through a wirebased communication medium.

As yet another variation, each chair within the gaming establishment 10 may include sensors. To discriminate against one another, each sensor may have a unique identifier, which is sent with any data to the site controller 52. In this manner, the site controller 52 can effectively "know" when a player sits in a particular chair 60 because the site controller 52 receives an indication of someone sitting in a particular chair 60, and may, if the thermal sensor 66, 72 is present, "know" the temperature of the patron based on information received from the thermal sensor 66, 72. As yet another possibility, the sensors may not have unique identifiers, but the chairs 60 might. Then, when a sensor reports, it reports the chair identifier with its data so that the site controller 52 is informed of the chair 60 that detected the activity that triggered the sensor. While it is specifically contemplated that the sensors actively report to the site controller 52, in an alternate embodiment, the site controller 52 must request the information, such as by polling the sensors of each chair 60. In either event, the information of the sensors is delivered to the site controller 52. Such polling may be done sequentially so as to avoid collisions or simultaneously with a collision control algorithm in place.

While temperature, vibration and weight sensors are all specifically contemplated for use in the chair 60, other biometric sensors may also be used in the chair 60. For example, a pulse rate sensor, a skin conductance sensor, and the like could all be used. Such sensors may be positioned on the chair 60 at a location where the player is likely to place a hand or other exposed skin surface.

Figure 4:
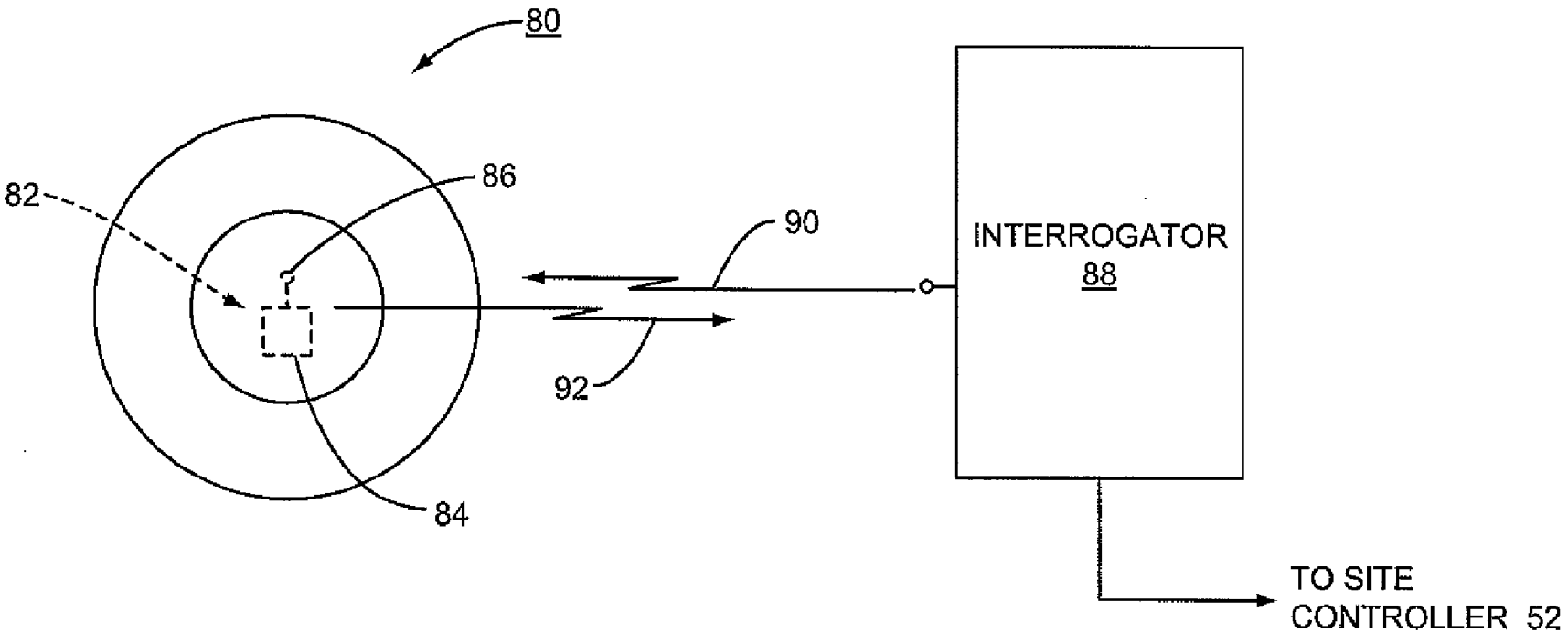
FIG. 4 illustrates an RFID chip and interrogator according to one embodiment of the present invention.

Another possible sensor that may be used by certain embodiments of the present invention is in the chips or jettons used by the gaming establishment 10. Specifically, as illustrated in FIG. 4, a chip 80 may include a radio frequency identification (RFID) tag 82 with an electronic circuit 84 and antenna 86. The chip 80 may be similar or identical to that disclosed in U.S. Pat. Nos. 5,166,502; 5,676,376; 6,021,949; and 6,296,190, which are all incorporated herein by reference in their entireties. Gaming Partners International (GPI), of 1182 Industrial Road, Las Vegas, Nev. 89102 and Shuffle-Master, Inc. of 1106 Palms Airport Drive, Las Vegas, Nev. 89119 both sell RFID chips suitable for use in the present invention, although neither product is specifically required to practice embodiments of the present invention. The GPI chip uses a standard microchip made by Philips Semiconductors called the Vegas S, each of which has a unique serial number. The gaming establishment 10 may associate values with each serial number. The association may be in a look-up table or the like. Alternatively, the unique identifier may be encoded to include value information. Likewise, the chips 80 may be color-coded or include other visible indicia that indicate their value to a player or a camera 56.

The electronic circuit 84 and antenna 86 act as a transponder capable of responding to an interrogator 88. In essence, the interrogator 88 sends out an electromagnetic signal 90 that impinges on the antenna 86 of the chip 80, exciting a current within electronic circuit 84. In response to the excited current, the electronic circuit 84 causes the antenna 86 to emit a second electromagnetic signal 92 as a response, which is received by the interrogator 88. The second signal 92 has identifying information about the chip 80 encoded therein such that the interrogator 88 can identify the chip upon receipt of the second signal. The second signal may be generated passively or actively. That is, in a first embodiment, the energy from the interrogation signal 90 provides sufficient power for the electronic circuit 84 to use to send the second signal 92. In a second embodiment, the electronic circuit 84 may include a battery or other power source, which is used to power the generation of the second signal 92. While batteries have increasingly small footprints and longer lives, it is generally more practical to have a passive transponder. The interrogator 88 may communicate with the site controller 52 so as to pass along information received by the interrogator 88.

Figure 5:
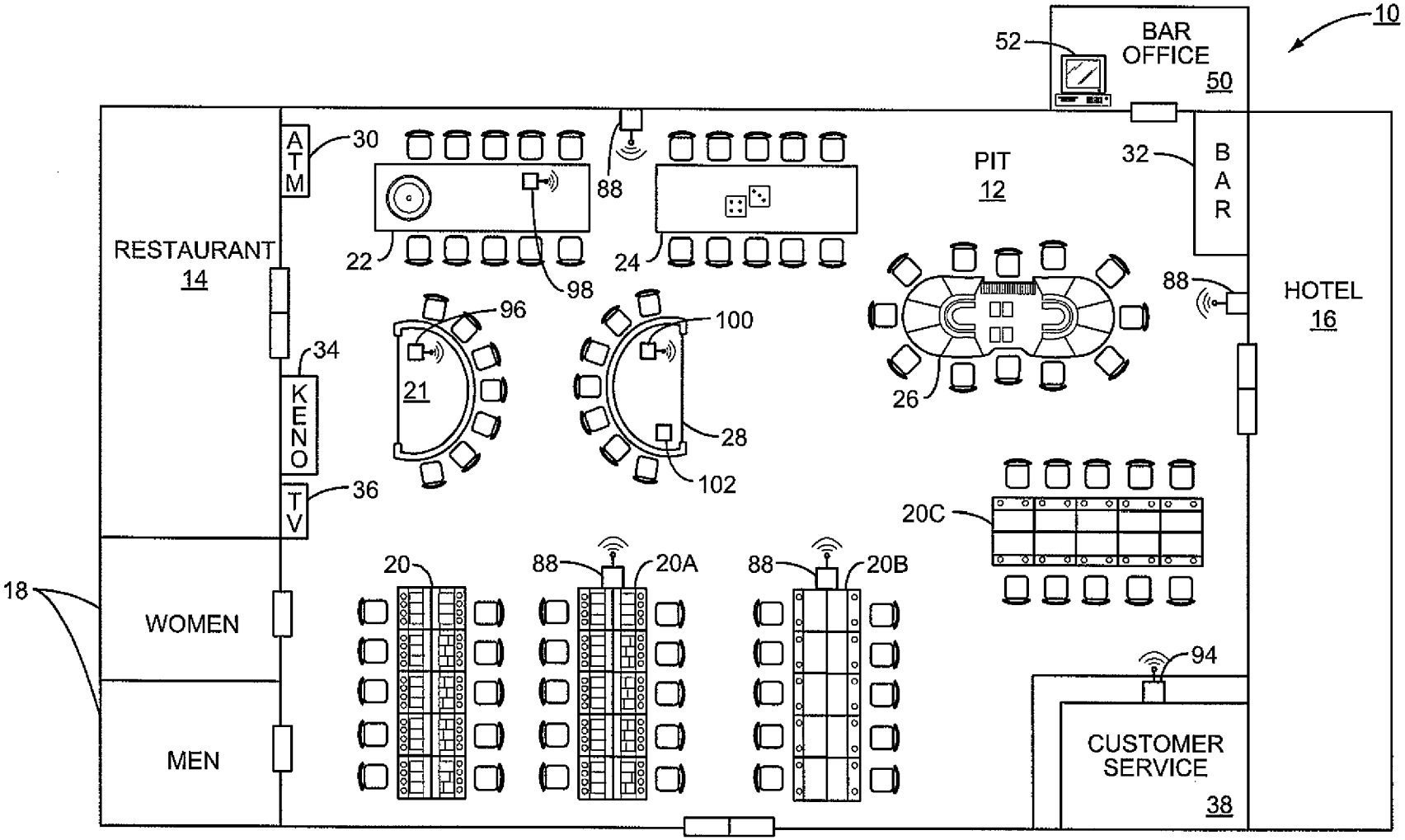
FIG. 5 illustrates an interrogator network within the gaming establishment according to one embodiment of the present invention.

GPI SAS, the European branch of GPI, sells interrogators and recommends that they be placed throughout the gaming establishment to track and account for chip movements in the gaming establishment. In an exemplary embodiment illustrated in FIG. 5, interrogators 88 may be positioned throughout the pit 12. Additionally, a cage interrogator 94 may be associated with the customer service booth 38. The cage interrogator 94 may be the CAGE READER or CHIP BANK READER sold by GPI or those described in U.S. Pat. Nos. 4,814,589; 5,283,422; 5,367,148; 5,651,548; and 5,735,742, all of which are incorporated herein by reference in their entireties. A blackjack interrogator 96 may be associated with the blackjack table 21 and may be the BLACKJACK FLOAT TRAY READER sold by GPI. A roulette interrogator 98 may be associated with the roulette table 22 and may be the ROULETTE FLOAT TRAY READER sold by GPI. Other tables, such as Caribbean Stud table 28 may have a table interrogator 100 and or a tip interrogator 102 such as the TABLETOP AUTHENTICATOR and the TIP BOX READER respectively, both sold by GPI. Each interrogator 88, 94, 96, 98, 100, and 102 may report its data to the site controller 52 through any appropriate communication link. As noted elsewhere, this report may be an active report or in response to polling by the site controller 52. For the purpose of the present invention other chip tracking devices such as the EASY CHIPPER™ sold by Shufflemaster may be used to track and count chips 80, even if they do not have a specific RFID interrogator included therein.

Another RFID tag and interrogator suitable for use with at least some of the embodiments of the present invention are produced by Texas Instruments as the TAG-IT™ product line. An improved interrogator is discussed in U.S. Patent Application Publication 2006/0077036, which is hereby incorporated by reference in its entirety.

Using this RFID sensor suite allows movement of chips 80 in the pit 12 to be monitored. As disclosed herein, the chips 80 may be associated with a particular player, and thus, player movement and player wagers may be monitored.

Instead of (or in addition to) tracking chip movements throughout the pit 12 to track patron movement, patrons may be issued a player identification item (such as a key fob, card, or dongle) that includes an RFID tag, and then RFID interrogators track the position of the patron based on the location of the RFID tag. An example of such a system is described in U.S. Patent Application Publication 2006/0076401, which is incorporated herein by reference in its entirety. Again, the interrogators of this alternate system may report to the site controller 52.

Figure 6:
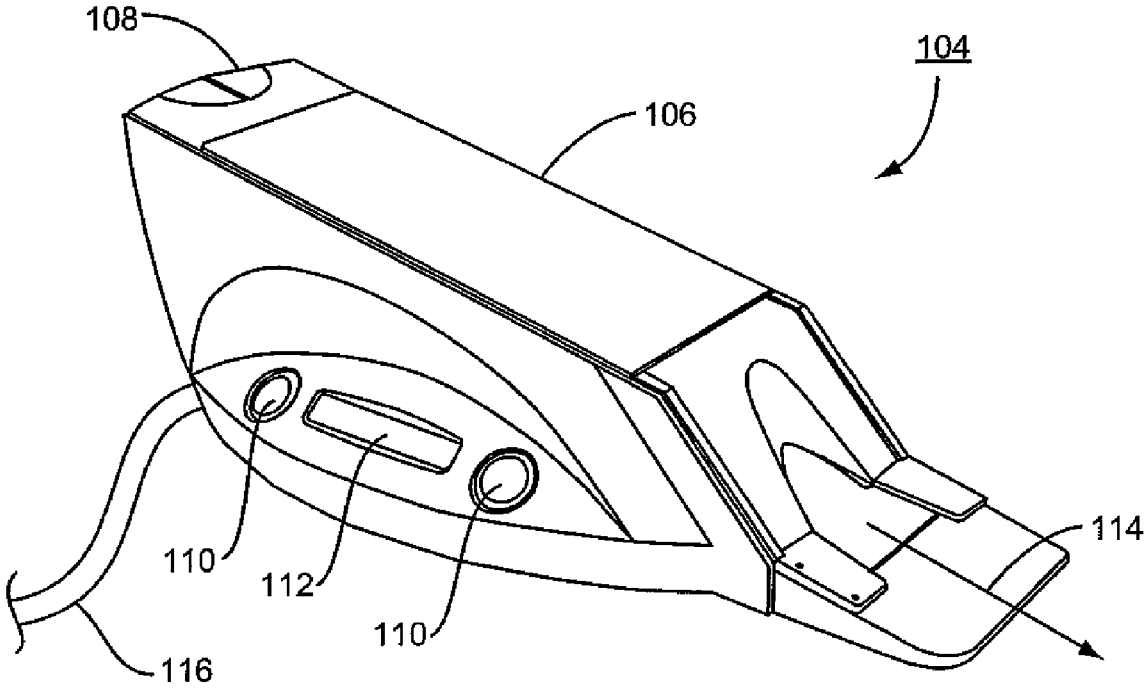
FIG. 6 illustrates an intelligent shoe according to one embodiment of the present invention.

Another sensor suitable for use with at least some embodiments of the present invention is an intelligent shoe that tracks what cards are dealt to which players. Specifically, a shoe 104 (illustrated in FIG. 6) may include a housing 106 with lights 108, buttons 110, display 112, and a card ejector path 114. Buttons 110 control operation of the shoe 104 while lights 108 and display 112 indicate which cards have been dealt to which players. Exemplary intelligent shoes are the IS-T1 ™ and IS-B1 ™ sold by ShuffleMaster. Further information about intelligent shoes may be found in U.S. Pat. Nos. 5,941,769 and 7,029,009 both of which are incorporated by reference in their entireties and U.S. Patent Application Publication Nos. 2005/0026681; 20017862227; 2005/0051955; 2005/0113166; 2005/0219200; and 2005/0062226 all of which are incorporated by reference in their entireties. In essence, the shoe 104 includes an optical sensor that detects the rank and suit of each card. As each card is dealt, the shoe 104 tracks which position received which card so as to know which player positions (or dealer position if applicable) have which cards. Based on a rule set programmed into memory, the shoe 104 may determine which position has the winning hand. Information to this effect may be presented on the display 112 as needed or desired. Additionally (or alternatively), the shoe 104 may report to the site controller 52 through a communication link 116. While illustrated as a wired communication link, communication link 116 could be wireless if needed or desired. Also, processing of which hand is a winning hand may be moved from the shoe 104 to the site controller 52 if needed or desired. Some intelligent shoes are designed for specific games such as baccarat or blackjack. Embodiments of the present invention are not limited to a particular game and may accommodate these various different types of shoes.

As an alternative to reading the cards optically, the playing cards may carry a conductive material on them such that they may be interrogated wirelessly. An example of such a system is disclosed in U.S. Patent Publication No. 2004/0207156, which is incorporated by reference in its entirety. The '156 publication also discloses interrogators for interrogating chips, and its methodology may be used for chip tracking as described herein.

Figure 7:
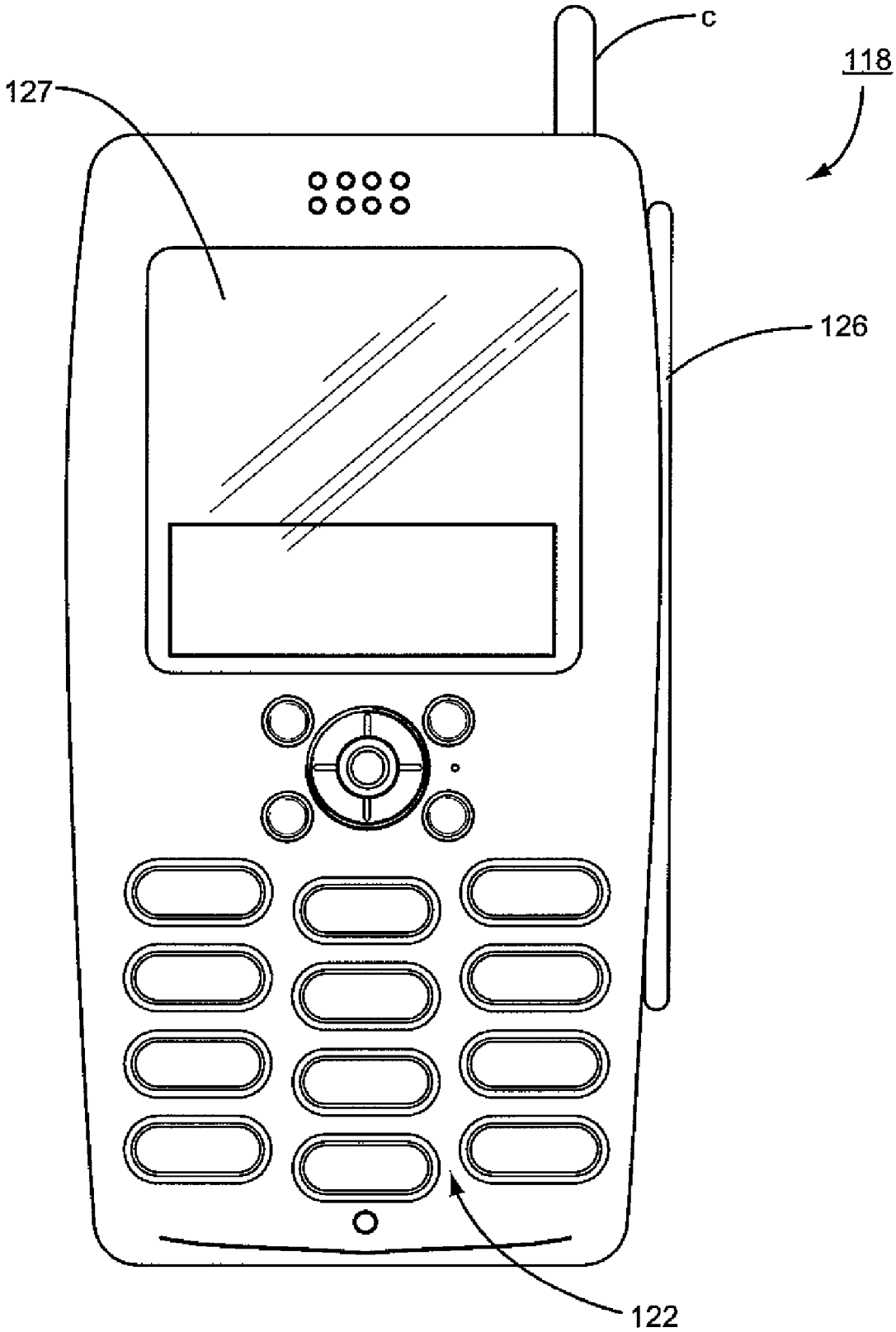
FIG. 7 illustrates a mobile terminal for use according to one embodiment of the present invention.

Another sensor suitable for use with at least some embodiments of the present invention are the perceptions of gaming establishment personnel as reported through a number of mechanisms, such as a mobile terminal 118, illustrated in FIG. 7. The mobile terminal 118 may be a personal digital assistant (PDA), cellular telephone, two way pager with or without text messaging, laptop, or the like as needed or desired, although a PDA is illustrated. The mobile terminal 118 may have a housing 120, a keypad 122, and a display 124. The display 124 may be a touch screen actuated with a stylus 126. The mobile terminal 118 may have other inputs and outputs such as microphones, camera, and speakers as needed or desired. The mobile terminal 118 may communicate with the site controller 52 through an antenna 128, other wireless communication technique, or may have to dock with the site controller 52 to pass information to the site controller 52. The mobile terminal 118 may communicate with the site controller 52 indirectly, such as through a cellular network and/or the internet (neither shown) if needed or desired. The mobile terminal 118 may also communicate with the other sensors described herein through any appropriate communication technique (wirebased or wireless) as needed or desired and then may relay the information to the site controller 52 as appropriate. Gaming establishment personnel may use the various inputs of the mobile terminal 118 to provide observations about patrons within the pit 12. For example, the personnel could type in observations about a patron using the keypad 122; dictate a quick verbal description through the microphone; select behaviors from drop down menus or other graphical user interface from the display 124 or otherwise provide input about patron behavior based on observations. Such observations may be input in real time or after a delay where the personnel has privacy to make a full report of the patron's behavior. Likewise, the gaming establishment personnel may activate an input to record patron behavior. For example, the microphone can record verbal exclamations from the patrons and the camera can record still or video images of the patron, which in turn may be passed to the site controller 52 as previously discussed.

In some embodiments, an input from the gaming establishment personnel may trigger a function to be performed by a sensor or other device. For example, an indication by a dealer of a table card game that a new player has taken a seat at the table may cause a camera 56 to focus on the player in order to capture the player's facial expressions.

Supplementing the mobile terminal 118 is a voice recording system, such as the BLOODHOUND™ monitoring software sold by ShuffleMaster (previously sold under the moniker BLACKJACK SURVEY VOICE). Gaming establishment personnel such as the dealer 40, croupier 42, floor man 44, or even pit boss 46 speak into a microphone (perhaps the microphone on the mobile terminal 118) and narrate each game. The narration may include facts such as units bet by each player, cards dealt to each player, play decisions, and the like. This data is received by the voice recording system software, which evaluates bet strategy for card counting and shuffle tracking. The software may do this automatically through voice recognition. As advertised, BLOODHOUND compares patron decision-making versus optimal basic strategy, and determines if the player alters his strategy based on the hole card or top card. In its current incarnation, BLOODHOUND is directed only at detecting card counters and expert blackjack players.

In contrast to BLOODHOUND, embodiments of the present invention take this underlying functionality and modify the functionality so that software according to embodiments of the present invention may track information to detect potential problem gambling and in particular track information provided by the gaming establishment personnel including a new player identifier, a new game commencing, apparent bankroll available to players, chip purchases made by individual players, and the like. This information may then be processed according to other embodiments of the present invention to determine if a patron is potentially a problem gambler. It is further possible to have a dedicated microphone (independent of the microphone in the mobile terminal 118) for the gaming establishment personnel. This microphone may be a discrete ear bug and throat microphone such as those worn by security personnel, a microphone in or on the gaming table, or other location as needed or desired.

Figure 8:
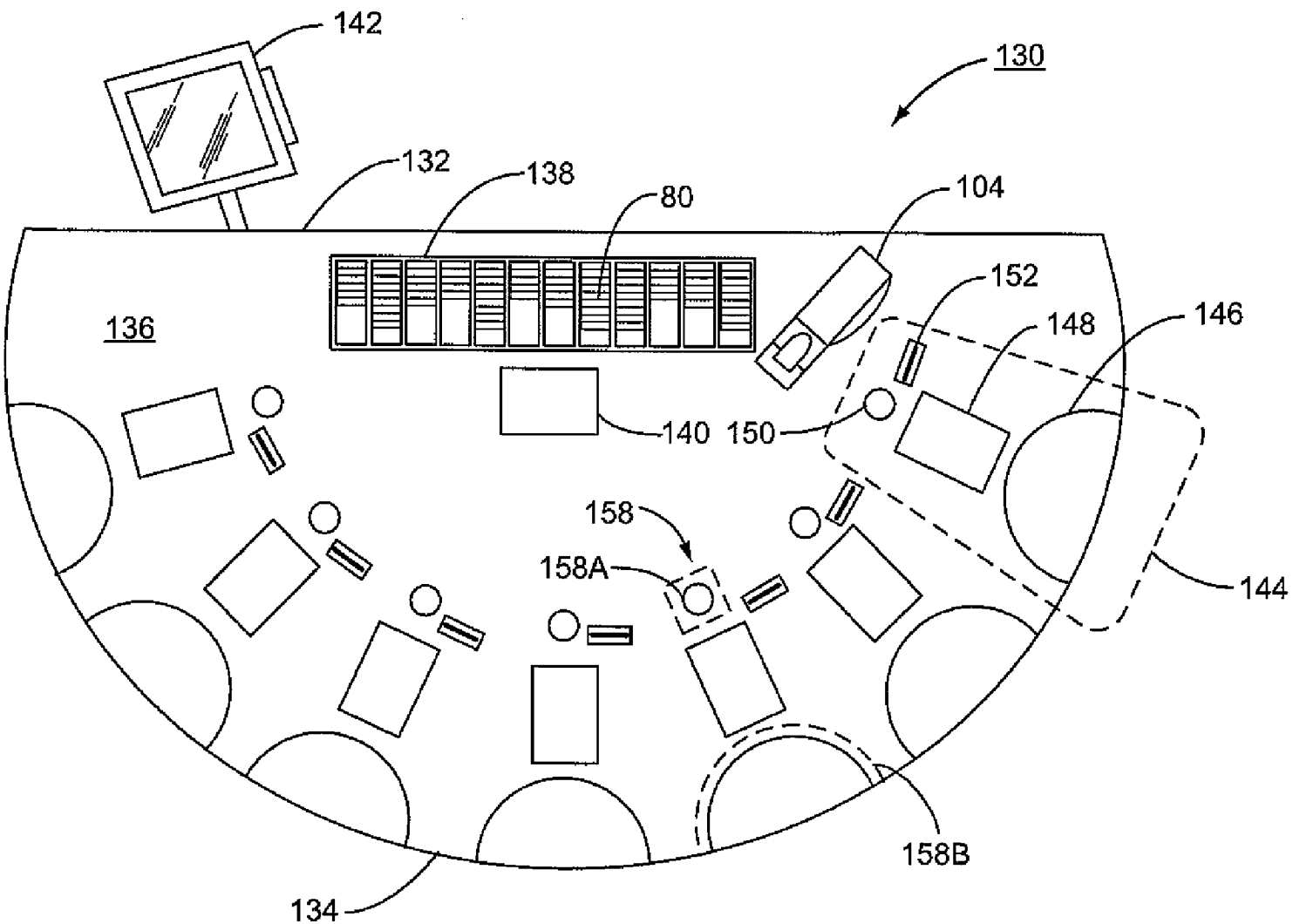
FIG. 8 illustrates an intelligent table according to one embodiment of the present invention.
Figure 9:
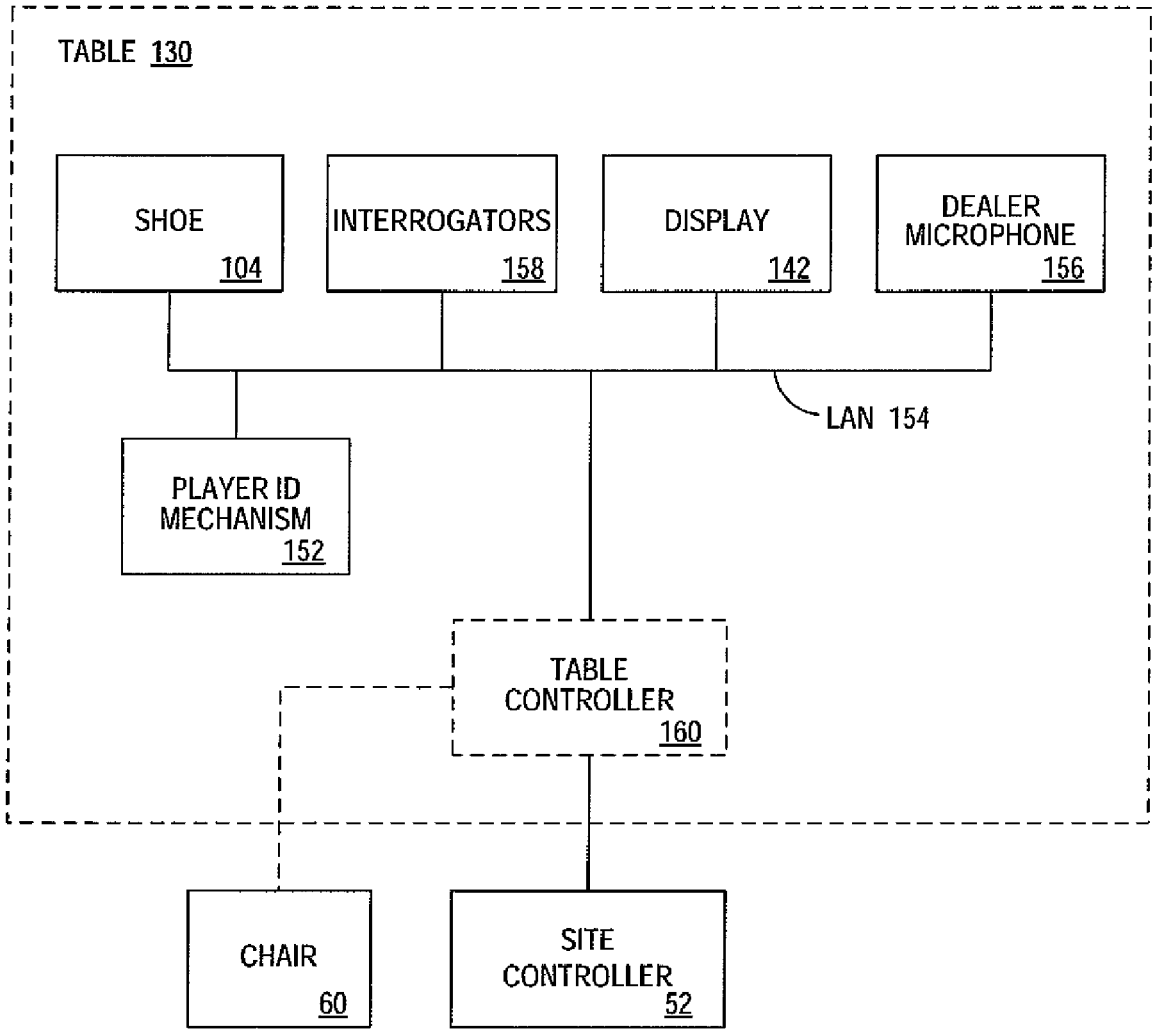
FIG. 9 illustrates as a block diagram components of the table of FIG. 8.

Another component that may be used is an intelligent table. An intelligent table is designed to track cards, wagers, and the like so as to monitor play at the table. An exemplary intelligent table 130 is illustrated in FIGS. 8 and 9, with alternate embodiments illustrated in FIGS. 10 and 11.

Progressive Gaming International, with Shufflemaster and IGT, sells an intelligent table under the moniker INTELLIGENT TABLE SYSTEM™ (ITS) together with software titled TABLE MANAGER™. Other intelligent table systems sold by Progressive include the TABLELINK PLAYER TRACKING, TABLELINK CHIP TRACKING, TABLELINK GAME TRACKING, TABLELINK TOTALVIEW, and TABLELINK CUBE. Further intelligent table teachings can be found in U.S. Pat. Nos. 6,676,517 and 7,011,309 as well as U.S. Patent Application Publication Nos. 2002/0147042; 2003/0003997; 2005/0026680; 2005/0026682; 2005/0051965; and 2005/0054408, all of which are incorporated by reference in their entireties. While these intelligent tables show how certain tracking functionality may be effectuated, these tables are not used to detect problem gambling and do not track certain types of behavior that are useful for certain embodiments of the present invention. In particular, none of the intelligent tables from the incorporated references teaches tracking a player's bankroll. Embodiments of the present invention cure this deficiency.

The following discussion is based on the premise that the intelligent table 130 is used for a tabletop card game. Appropriate changes may be included for a table that caters to craps, roulette, or other game without departing from the scope of the present invention. Intelligent table 130 is shaped like a traditional gambling table and may include a flat edge 132 behind which the dealer is positioned and a curved edge 134. The top surface 136 may be planar for card and dice games. The dealer side of the table may include a chip tray 138 with RFID chips 80 stored therein. A dealer's hand area 140 may be positioned in front of the chip tray 138 and cards associated with the dealer's hand (e.g., in Blackjack) or common cards (such as in Texas Hold 'Em) may be positioned therein. A display 142 may be positioned proximate the dealer's area. The display 142 may be a cathode ray tube, a liquid crystal display, a light emitting diode, or the like. If the dealer is using the voice recording system, the transcribed banter from the dealer caught by a microphone 156 (FIG. 9) may appear on the display 142. Otherwise, the display 142 may present other information as further described herein. Other information, such as an alert as to the existence of a problem gambler may also be presented on the display 142. The display 142 may also include speakers or bells through which an audible alert or other audible information may be provided to the dealer. A keyboard (not shown) may also be present for the dealer to provide additional input. Alternatively, the display 142 may be a touch screen display and the keyboard eliminated. An intelligent shoe 104 may also be positioned so as to be readily accessible by the dealer. While the intelligent shoe 104 makes an acceptable card recognition system, other card recognition systems (such as those advanced by the previously incorporated patents and applications) may also be used. A particularly contemplated embodiment is an interrogator that detects RFID tags associated with the playing cards.

While not shown, the table 130 may also have a printer, card or ticket dispensers, coin or bill dispensers and the like as needed or desired. Likewise, the table 130 may have one or more communication ports allowing communication with the site controller 52, mobile terminals 118 or other devices as needed or desired. Also while not shown, the table 130 may have other input devices such as buttons, switches, levers, dials, a mouse, a track ball, and the like for use by the dealer 40 (or other personnel).

Conceptually each player has a player position 144, which may be divided into a bankroll area 146, a hand area 148, a wager area 150, and a player identifier mechanism 152. Areas 146, 148, and 150 may be delimited by indicia (printed or otherwise appearing) on the top surface 136. The bankroll area 146 is designed to be a place where a player may store or hold her bankroll from which wagers are made. Some players may prefer to keep their bankroll in a pocket or the like, but by providing a bankroll area, embodiments of the present invention are facilitated. The hand area 148 is the area to which the dealer deals the player's hand and is common on tabletop gaming tables. The wager area 150 is the area into which the player places her wager and is common on tabletop gaming tables. The player identifier mechanism 152 is a device, such as a magnetic or smart card reader, into which the player may insert a player identifier card, swipe such a card, or otherwise provide an indication as to whom the player is that is sitting at the particular player position 144. Activation of the player identifier mechanism 152 may indicate a new player has taken a seat and is ready to play as well as help a gaming establishment 10 track players' gaming habits as further explained herein. Note that the player identifier mechanism 152 could be an interrogator that interrogates a player transponder, especially where the player identifier is provided to the player as a fob or dongle with the transponder disposed therein. Likewise, the player identifier mechanism 152 could be a biometric reader (fingerprint, retinal, or the like) or a keypad into which a player identifier code may be input.

A plurality of interrogators 158 are associated with the table 130 and are designed to help track movement of chips 80 about the table 130. In particular, wager interrogator 158A may interrogate each wager area 150 to ascertain how much is being wagered by a particular player. Note that while only one wager interrogator 158A is shown, a wager interrogator 158A may exist for each wager area 150 on the table 130. In addition to wager interrogator 158A, each player position 144 may also be associated with a bankroll interrogator 158B, which interrogates the respective bankroll area 146 to ascertain how much money the player has available in her bankroll. Additional interrogators 88, 96, 98, 100, or 102 may also be present on the table 130 (although not illustrated in FIG. 8). The simplest implementation for the table 130 has a separate interrogator 158 (and/or 88, 96, 98, 100, or 102) for each area of interest 138, 146, 150. Other embodiments are also possible as discussed further herein. In an exemplary embodiment, the interrogators 158 are positioned on or otherwise associated with the underside of the playing surface. In an alternate embodiment, the interrogators 158 are embedded into the playing surface in such a manner that the planar playing surface is not disrupted.

In an exemplary embodiment, the interrogators 158 directly determine the value of the chips 80 in a particular area being interrogated. This valuation is effectuated by the value being part of the information that the chips 80 provide to the interrogators 158 and the interrogators 158 summing those values. Alternatively, the interrogators 158 may pass the values unsummed to a controller (such as a table controller or site controller 52), which performs the calculation. As yet another alternative, the value may be derived indirectly. Chips 80 may only provide unique identifiers, in which case the controllers may reference a look-up table and derive the values based on the identifiers and then perform the summation. While it is contemplated that the bankroll value will not be made available to the player, in an alternate embodiment, a display associated with each player position 144 may present the bankroll value so that a player may ascertain through a casual inspection of the display how much the player has available to wager. This may assist the player in pacing themselves or otherwise evaluate the gambling session. Likewise, the player may use this display to manage chips with which the player is unfamiliar and whose value is not immediately apparent to the player. However, such a player display is optional.

As illustrated, seven player positions 144 are positioned on the table 130, but fewer or more may be used as needed or desired. Additionally, to accommodate other games, other indicia or play areas may be provided as needed or desired. While it is anticipated that the tabletop may be wood or laminate material covered by a felt covering, other materials such as glass could be used as needed or desired. In one embodiment, the table may comprise a video screen operable to alter the indicia displayed thereon. In another embodiment, the table may comprise a surface onto which indicia is projected from above. Depending on placement of the interrogators 158, the tabletop may need to be transparent to the electromagnetic frequency used by the interrogators 158.

The elements of the table 130 are interconnected by a LAN 154 illustrated in FIG. 9. Specifically, the intelligent shoe 104, the display 142, the player identification mechanism 148, a dealer microphone 156 (such as is used in the voice recording system), and interrogators 158 are connected by the LAN 154. Additionally, the chairs 60 (together with their weight/temperature sensors) in which the players sit may be communicatively coupled to the LAN 154 if needed or desired. These components may report to a table controller 160. The table controller 160 may be communicatively coupled to the site controller 52. If the table controller 160 is not present, then the LAN 154 may be connected to the site controller 52 directly. The LAN 154 may be wired or wireless as needed or desired.

In the embodiment illustrated, each interrogator 158 may have its own address, which is associated with the corresponding player position 144, and which is appended to any information reported to the table controller 160. In this manner, the table controller 160 effectively knows (as a function of this reporting) how much each player is wagering and has in her bankroll by reference to the address. The information may be correlated to the player identifier received from the player identification mechanism 152.

Additional sensors such as a vibration sensor (not illustrated) may be associated with each player position 144. Such a vibration sensor may detect finger tapping or fidgeting by the patron. Another auxiliary sensor that could be used is a temperature sensor directed at the patron's chair. For example, a thermal IR camera could detect the player's temperature. Alternatively, a thermometer could be embedded in the table at a position that the player is likely to rest her hand. Other biometric readers could, if properly positioned like the thermometer, also be used such as a pulse rate sensor, a skin conductance sensor and the like. Also while not specifically illustrated, a weight or pressure sensor may be used to detect a player, a player's bankroll, a player's wager, or the like. Motion or other optical sensors may be used to detect a player or player activity. Magnetic sensors, including, but not limited to functional magnetic resonance imaging (fMRI) devices, and/or Britton Chance's near infrared brainwave detectors may also be used as needed or desired.

Figure 10:
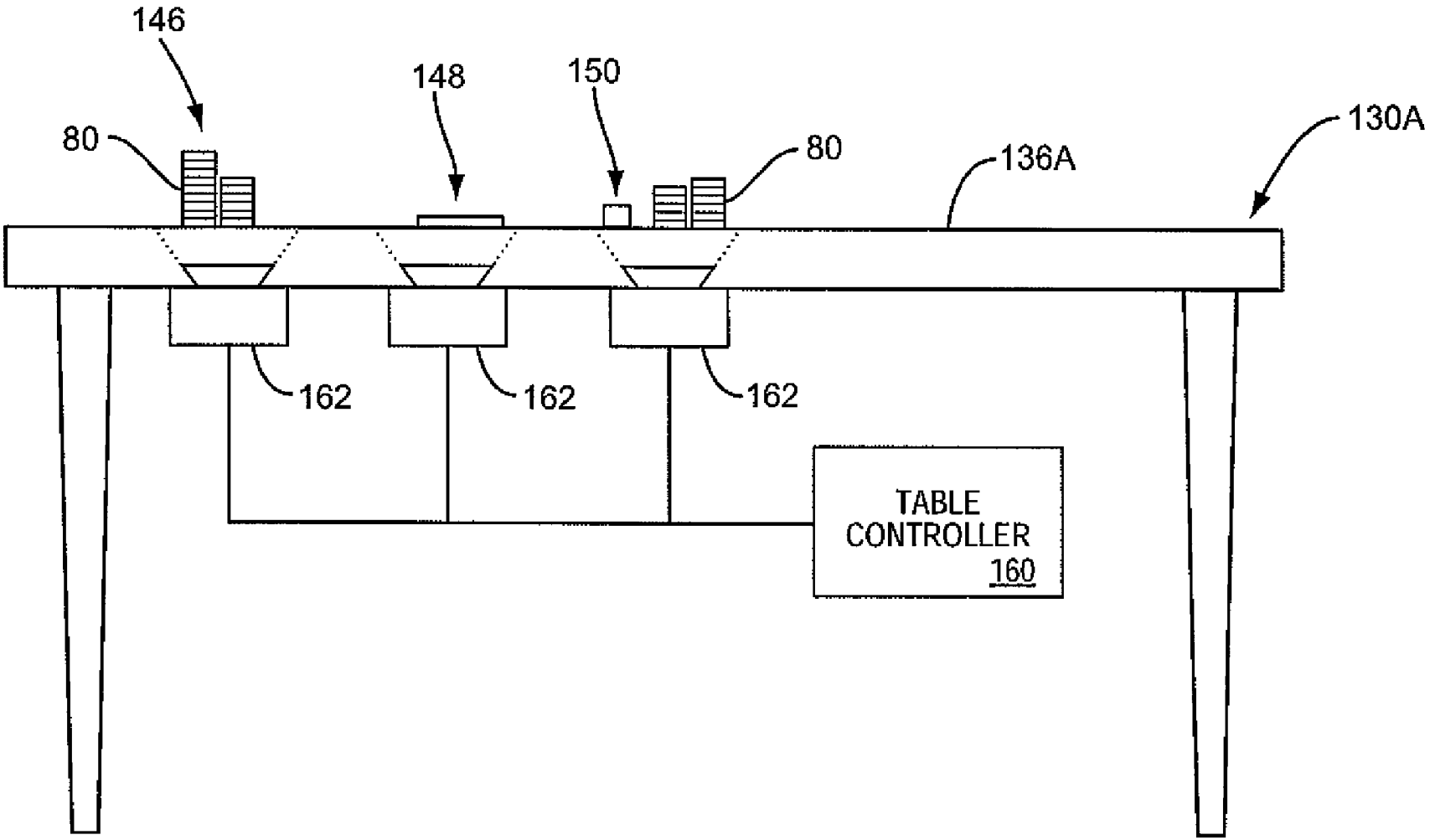
FIG. 10 illustrates an alternate embodiment of an intelligent table using cameras for player activity detection.

Instead of interrogators 158, cameras 162 may be used to detect bankrolls, wagers, and cards as illustrated in FIG. 10. That is, alternate table 130A may not use interrogators 158 to track wagers, cards, or bankrolls. The tabletop 136A may be glass and the cameras 162 may see through the glass to capture images of cards dealt face down to players and ascertain how many chips are in bankroll area 146 or wager area 150. While illustrated directly under the positions, the cameras 162 may be offset so as to get a lateral view so as to help count stacked chips 80. The glass may be "one-way" glass such that light passes through the glass in only one direction (e.g., such as that used in the "Don't Miss a Sec" public toilet originally presented at the Tate Museum or interrogation rooms). While multiple cameras 162 are shown, it is possible that a single well-positioned camera 162 could capture all the images it needs for all the positions. Other cameras may be used to (as noted above) detect temperatures of the patrons or record facial expressions and/or nonverbal cues of the patrons. Likewise, instead of positioning the cameras 162 under the table, overhead or lateral cameras could be used if needed or desired.

Figure 11:
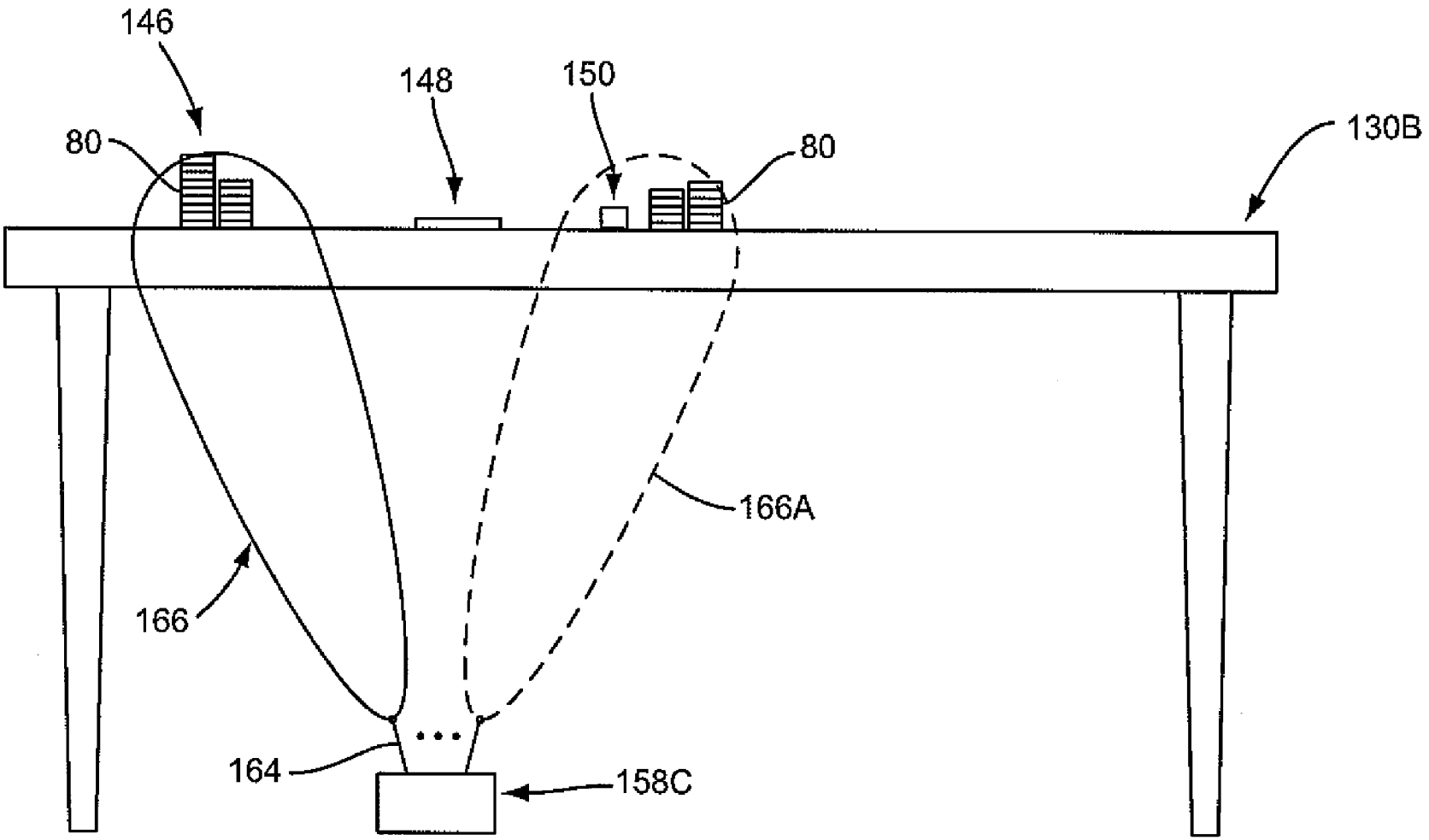
FIG. 11 illustrates another alternate embodiment of an intelligent table with a consolidated interrogator.

As another alternative, the nature of the interrogators 158 may be varied. In particular, table 130 of FIGS. 8 & 9 contemplates a plurality of interrogators, each with its own transceiver and antenna. However, as illustrated in FIG. 11, a table 130B may have a consolidated interrogator 158C. The interrogator 158C may have a repositionable antenna 164 that allows the electromagnetic field 166 to be directed to various locations on the table 130B. For example, when the antenna 164 is in a first position, the electromagnetic field 166 may interrogate the bankroll area 146 of a player position 144, and, when the antenna 164 is in a second position, the electromagnetic field 166A may interrogate the wager area 150 of the player position 144. A motor may move the antenna 164 between the two positions. While illustrated as moving only between two positions, it is within the scope of the invention that a single antenna 164 may be repositioned so as to interrogate each of the areas of interest of each of the player positions 144 at a table 130 as well as chip tray 138 and/or any other area of interest.

As yet another alternative (not illustrated), a single interrogator 158 may have an array of addressable antennas 164 (for example, an address may correspond to a switching arrangement that electrically couples only a single antenna to the transceiver circuitry of the interrogator). Each antenna creates an electromagnetic field 166 that interrogates a particular area of interest. In this manner, the interrogator 158 sends a signal to a particular antenna 164 to interrogate a particular area of interest. The response received by the selected antenna 164 is then reported to the table controller 160. For the purposes of the present invention such an array and the repositionable antenna 164 may be thought of as being first and second interrogators, even though they are in a single device.

While it is contemplated that the intelligent table 130 will be designed for a single type of game, it is possible that the table may be reconfigured to support different types of game (e.g., switching from Blackjack to Caribbean Stud). This change may be effectuated by replacing or covering the original felt on the tabletop with a second felt covering having appropriate indicia for the new game or by otherwise altering the indicia associated with the table (e.g., altering the indicia projected onto the table from above). Interrogators 158 may have to be repositioned in such an event. Alternatively, other interrogators 158 may already be in position, but not operational until such a time as the change is made. Still another option would be to selectively illuminate lights embedded in a glass tabletop. In such an instance, the lights correspond to the appropriate indicia needed to conduct the particular game.

As will be appreciated, the use of an intelligent table with or without the other sensors of the present invention allows embodiments of the present invention to track player activity while gambling. While it is contemplated that the interrogators 158 will report to the table controller 160 and/or the site controller 52, it is possible that the controllers 160, 52 will poll the interrogators 158 for information. In either event, the information collected by the interrogators is delivered to the appropriate controller 52, 160.

Figure 12:
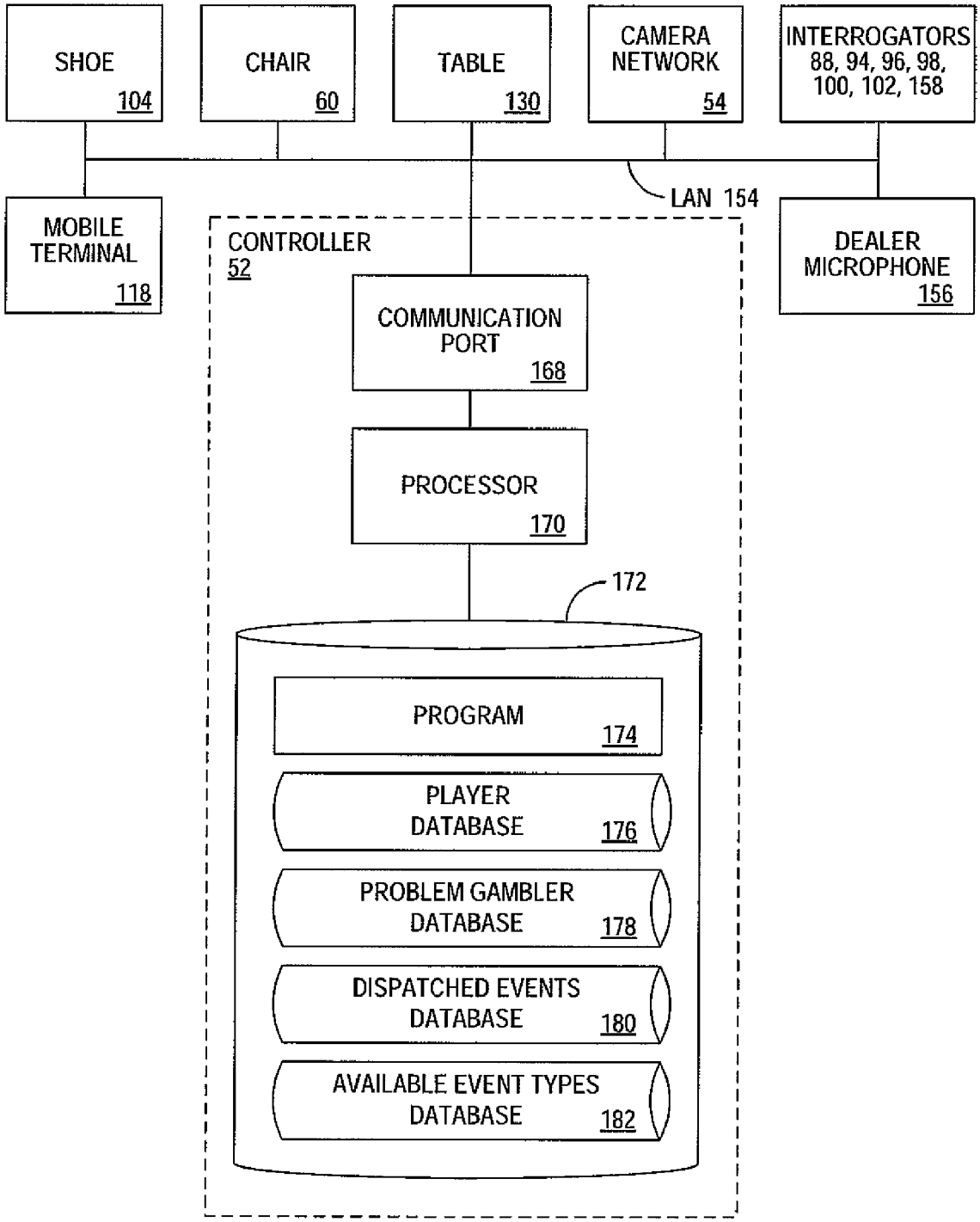
FIG. 12 illustrates an exemplary embodiment of a site controller for the present invention.

In a particularly contemplated embodiment, player information is collected by the site controller 52 as better illustrated in FIG. 12. In particular, the various sensors (including camera network 54, chairs 60, interrogators 88, 94, 96, 98, 100, 102, 158, shoes 104, mobile terminals 118, tables 130, voice recording system and the like) of the various embodiments of the present invention may report to the site controller 52 over a LAN (illustrated) or other communication network (not illustrated). While illustrated as a single LAN, it is possible that the various sensors may have separate communication networks specialized for the types of information sent to the site controller 52.

The site controller 52 may be implemented as a system controller, a dedicated hardware circuit, an appropriately programmed general-purpose computer, or any other equivalent electronic, mechanical or electro-mechanical device. The site controller 52 may comprise, for example, one or more server computers operable to communicate with one or more client devices.

The site controller 52 has one or more communication ports 168 (one illustrated) connected to the LAN and to a processor 170. The processor 170 may be a microprocessor as is well understood, such as one or more Intel® Pentium® processors. The processor 170 also communicates with memory 172 having programs 174 and databases stored therein. Exemplary databases include player database 176, problem gambler database 178, dispatched events database 180, and available event types database 182.

The memory 172 might comprise an appropriate combination of magnetic, optical and/or semiconductor memory, and may include, for example, Random Access Memory (RAM), Read-Only Memory (ROM), a compact disc and/or a hard disk. The processor 170 and the memory 172 may each be, for example: (i) located entirely within a single computer or other device; or (ii) connected to each other by a remote communication medium, such as a serial port cable, telephone line or radio frequency transceiver. In one embodiment, the site controller 52 may comprise one or more devices that are connected to a remote server computer for maintaining databases.

The processor 170 performs instructions of the program 174, and thereby operates in accordance with the present invention, and particularly in accordance with the methods described in detail herein. The program 174 may be stored in a compressed, uncompiled and/or encrypted format. The program 174 furthermore includes program elements that may be necessary, such as an operating system, a database management system and "device drivers" for allowing the processor 170 to interface with computer peripheral devices. Appropriate program elements are known to those skilled in the art, and need not be described in detail herein. The program 174 may include computer program code that allows the site controller 52 to employ the communication port 168 to communicate with the sensors described above to, for example: track gambling or other activity performed at the gaming device; track gaming or other activities of individual players; track movement and/or facial expressions of a player at a gaming device; determine any sound emitted by a player; determine whether a player qualifies as a problem gambler or potential problem gambler; dispatch an event if a player qualifies as a problem gambler or potential problem gambler; instruct a gaming device or dealer to perform one or more functions (e.g., output a message to a player, interrupt play, etc.); determine whether a player has previously been identified as a problem gambler or potential problem gambler; assign or otherwise determine a unique identifier for a player who has been identified as a problem gambler or potential problem gambler; receive an input from personnel regarding a player who has been identified as a problem gambler or potential problem gambler (e.g., an input indicative of the personnel's interaction with the player); controlling (e.g., preventing or regulating) access to stored funds and/or a credit line; and/or direct a device (e.g., a security camera in the gaming establishment, a camera of a gaming device, a camera of a peripheral device, etc.) to focus on a particular player who has been identified as potentially a problem gambler.

According to an embodiment, the instructions of the program 174 may be read into a main memory from another computer-readable medium, such from a ROM to RAM. Execution of sequences of the instructions in program 174 causes processor 170 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

In some embodiments, the memory 172 may store additional databases. Examples of such additional databases include, but are not limited to, (i) a gaming device database that stores information related to one or more gaming devices with which the site controller 52 is operable to communicate, (ii) a game database that stores information regarding one or more games playable on and/or downloadable to one or more gaming devices, and (iii) a scheduling and/or configuration database useful for determining which games are to be made available on which gaming devices.

Although the databases 176 through 182 are described as being stored in a memory 172, in other embodiments some or all of these databases may be partially or wholly stored, in lieu of or in addition to being stored in a memory 172, in a memory of one or more other devices. Such one or more other devices may comprise, for example, one or more peripheral devices, one or more gaming devices, a slot server, another device, table controller 160, or a combination thereof. Further, some or all of the data described as being stored in the memory 172 may be partially or wholly stored in a memory of one or more other devices.

Example embodiments of the databases 176 through 182 are described in detail below and example structures are depicted with sample entries in the accompanying figures. As will be understood by those skilled in the art, the schematic illustrations and accompanying descriptions of the sample databases presented herein are exemplary arrangements for stored representations of information. Any number of other arrangements may be employed besides those suggested by the tables shown. For example, even though four separate databases are illustrated, the invention could be practiced effectively using one, two, three, five or more functionally equivalent databases. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention.

The specific data and fields illustrated in these drawings represent only some embodiments of the records stored in the databases described herein. The data and fields of these databases can be readily modified, for example, to include more or fewer data fields. A single database also may be employed. Note that in the databases, a different reference numeral is employed to identify each field of each database. However, in at least one embodiment, fields that are similarly named (e.g., player identifier fields) may store similar or the same data in a similar or in the same data format.

Figure 13B:
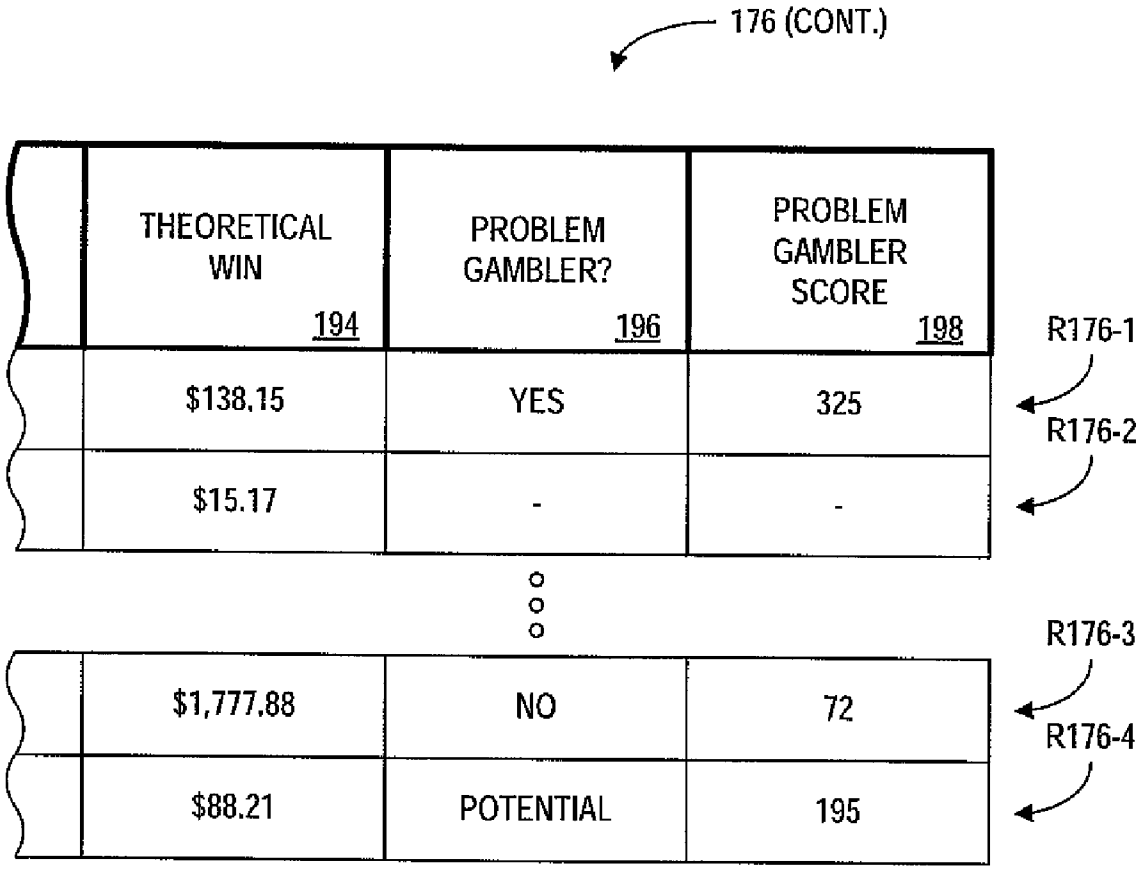

Referring now to FIG. 13A and FIG. 13B, illustrated therein is a tabular representation of an example player database 176. The player database 176 may be stored in a memory of a device (e.g., memory 172 of site controller 52) in tabular form, or any other appropriate database form, as is well known in the art. The data stored therein may include a number of exemplary records or entries, including records R176-1 through R176-4, each defining a player. Those skilled in the art will understand that the player database 176 may include any number of entries.

The player database 176 may also define fields for each of the entries or records. The fields specify: (i) a player identifier field 184 that (e.g., uniquely) identifies a player; (ii) a name field 186 that indicates a name of the player; (iii) an address field 188 that indicates contact information associated with the player (e.g., a postal address, an e-mail address, a telephone number, a pager number or other information allowing the player to be contacted); (iv) a player since field 190 that indicates a date at which a player became a member of a gaming establishment slot club or otherwise began to be tracked by a gaming establishment or other entity; (v) a total wagered field 192 that indicates an aggregate amount that the player has wagered within a predefine period of time, or that the player has deposited in a gaming device or made available for wagering at a gaming device within a predefined period of time (e.g., since the player's wagers began to be tracked, during a current visit to a gaming establishment, within a current year, etc.), (vi) a theoretical win field 194 that indicates a theoretical win associated with the player for a predefined period of time; (vii) a problem gambler status field 196 that indicates a status of the player with respect to a problem gambler designation; and (viii) a problem gambler score 198, if any, that is associated with the player.

Of course, the player database 176 may include different and/or additional fields that store information such as, for example, (i) a financial account identifier of the player, which may be, e.g., a credit card, debit card or checking account number; (ii) demographic data about the player, such as the age, gender, income level of the player; (iii) credits and/or complimentary points which the player has accumulated in one or more previous and current plays at one or more gaming devices or tabletop games; and/or (iv) an indication of a behavioral pattern of the player (e.g., frequent gambler, weekend gambler, maximum wager gambler on high denomination machines, play until credit balance zero gambler, etc.).

A device (e.g., a controller 52) may utilize the player database 176 to determine, for example, whether a player has previously been identified as potentially requiring attention as a problem gambler (e.g., based on a problem gambler status from field 196 associated with the player and/or a problem gambler score from field 198 associated with the player). For example, once a player inserts a player tracking card into a player identifier mechanism 152, the player identifier of the player tracking card may be utilized to determine whether the player qualifies as a problem gambler and/or what problem gambler score, if any, is associated with the player. Certain fields within the player database 176 may be empty for an anonymous patron who is being tracked. It should be noted that, to accommodate such anonymous patrons, in some embodiments, a player identifier may comprise a picture or image of the player or a current position of the player within the gaming establishment 10 (e.g., seat two at table sixty-three). Thus, a player currently playing may be associated with a previously created record in the player database 176 by capturing an image of the player and comparing the image to images stored in the player database 176. If the image matches an image of a record in the player database 176, it may be determined that the data of that record is, at least likely, to be data associated with the player currently playing.

The data stored in the problem gambler status field 196 may comprise, for example, an indication of whether the corresponding player has been identified as a problem gambler or as potentially requiring attention as a problem gambler. In some embodiments, such a status may indicate the certainty with which a player has been identified as a problem gambler (e.g., "potential", "maybe", "somewhat", "confirmed", etc.). Such a status may, in some embodiments, be indicated as a number, phrase, sign, or in another form. In some embodiments, such a status may be entered by gaming establishment personnel. In some embodiments, such a status may be entered by a device, based on a determination or analysis of one or more actions of the player. In some embodiments, a player status may change as more information is obtained about the player (e.g., a player status may change from "Yes" to "Potential" to "No" or in another order). In some embodiments, the status of a player as a problem gambler may be made available or known to a player while in other embodiments, such a status may be kept confidential from the player.

The data stored in the problem gambler score field 198 may be a numerical representation of a score calculated based on one or more actions of the corresponding player, the score being usable to determine whether the player is considered to be a problem gambler, a probable or possible problem gambler, or not a problem gambler. In one embodiment a score that represents a likelihood that a player is a problem gambler may be determined for a player (e.g., for each player whose activities are being tracked by a gaming establishment). Thus, as is described in more detail below, in one embodiment certain actions or behavioral patterns may be associated with respective amounts of points and the points may be added together as the player's activities and behavioral patterns are tracked. The sum of the points may be considered the player's problem gambler score. Such a score may be compared to a plurality of ranges or thresholds. For example, if a player's problem gambler score is equal to or greater than a first amount of points, the player may be considered as a potential problem gambler or borderline problem gambler. If a player's problem gambler score is equal to or greater than a second amount of points that is greater than the first amount of points, the player may be considered to very likely be a problem gambler. If the player's problem gambler score is equal to or greater than a third amount of points that is greater than the second amount, the player may be considered to potentially be an extreme problem gambler. In some embodiments, different events may be dispatched based on a player's problem gambler score. For example, a player may only be prevented from gambling or gambling on certain games, devices or in certain denominations if the player's score indicates that the player is an extreme problem gambler. Such different levels or grades of events are described in more detail below.

It should be noted that, in some embodiments, a player's problem gambler score may be decreased in response to certain events. For example, if a player does not perform any actions that indicate the player is a problem gambler for a certain period of time (e.g., one year), the player's problem gambler score may be decreased by a predetermined amount. Similarly, if a player exhibits certain desirable behavior or performs certain actions that indicate the player is engaging in healthy gambling activity (e.g., only wagering small amounts during each gambling session, cashing out after a big win and not risking the big win, accepting an offer from gaming establishment personnel for free or upgraded non-gambling activities (e.g., free show tickets or upgraded meals) etc.), the player's problem gambler score may be decreased in response. A more detailed description of what types of actions and/or behavioral patterns may affect a player's problem gambler score is provided below. Similarly, a more detailed description of what types of events may be dispatched based on a player's problem gambler score are described in more detail below.

In some embodiments, information stored in the player database 176 may be used to manage or affect a player's experience in a gaming establishment. For example, if a player is associated with a problem gambler status of "Yes" or "extreme", the player's gambling activity may be more carefully monitored than it otherwise would be, or a player may be prevented from gambling at certain times, for more than a certain amount of time, from wagering more than a certain amount within a given period of time, from wagering more than a certain denomination, from wagering on certain gambling activities, etc.

Figure 14:
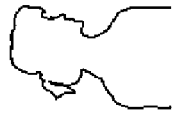
FIG. 14 illustrates a problem gambler database according to one embodiment of the present invention.

Referring now to FIG. 14, illustrated therein is a tabular representation of an example problem gambler database 178. The problem gambler database 178 may be stored in a memory of a device (e.g., memory 172 of controller 52) in tabular form, or any other appropriate database form, as is well known in the art. The data stored therein may include a number of exemplary records or entries, each storing information on a player identified as a problem gambler or potential problem gambler. Those skilled in the art will understand that the problem gambler database 178 may include any number of entries.

The problem gambler database 178 may be utilized, for example, to track information related to players identified as problem gamblers. For example, events dispatched in relation to the players may be stored. In some embodiments, an intrusiveness level of a dispatched event may be increased over time, as a player continues to require attention as a problem gambler and events continue to be dispatched due to this status of the player as a problem gambler. For example, in one embodiment, when a player is first identified as a problem gambler, gaming establishment personnel may approach the player and passively engage the player in conversation, the conversation not being directed to confronting the player about this problem gambling but rather intended to distract the player from his problematic gambling behavior. This may be considered to be a relatively un-intrusive interaction with the player. However, if such passive interventions by a gaming establishment employee appear to have no effect and the player continues to be identified as a problem gambler, a more intrusive event may be dispatched, such as outputting a problem gambler questionnaire to the player or requesting that the player consent to electronic surveillance of his gaming patterns to look for problem gambling. Once the player has consented to such activity, the dealer 40 (or other personnel) may request that the player actively use one or more sensors (e.g., place their finger on an electrode as bets are placed to measure skin conductivity and temperature, etc.). Still another dispatched event may be to ask the player to sign up for a player-tracking card. This activity may allow the player to be tracked with greater ease in the future for problem gambling detection. In extreme circumstances, a player may be prevented from gambling.

Accordingly, it may be desirable to track information related to players identified as problem gamblers, such as the events dispatched to the player. For example, a determination of what event to dispatch with respect to a player may at least partially be performed based on prior events that have been dispatched with respect to the player and/or the success of each of such events (e.g., did the player's gambling behavior improve, did the player's problem gambler score improve after the prior event was dispatched?).

The problem gambler database 178 may define fields for each of the entries or records. The fields may specify: (i) problem gambler identifier 200 that identifies (e.g., uniquely) a problem gambler or potential problem gambler; (ii) a date identified field 202 that indicates a date on which a player has been identified as a problem gambler or potential problem gambler (in some embodiments, an indication of what player action(s) and/or behaviors caused the player to be identified as a problem gambler may also be stored); (iii) a dispatched events field 204 that stores an indication or description of an event that has been dispatched with respect to the player (in some embodiments, this may be an identifier that corresponds to a description in another database); and (iv) a current status field 206 that indicates the player's current status as to whether the player is considered a problem gambler and/or what events or actions are to be taken with respect to the player's problem gambler status. For example, as indicated in the first record, the current status of player "P-000001" indicates that the player is to be prevented from placing wagers greater than or equal to $1.00. In another example, the second record of the database indicates that the player "Nora Smith" is to continue receiving low-grade interaction (i.e., events that are relatively not intrusive or aggressive are to be dispatched with respect to this player). As described below, in some embodiments events may be categorized into levels, each level corresponding to a different level of intrusiveness or aggressiveness. In such embodiments, the current status field 206 may store an indication of the level of event to be dispatched with respect to the player.

It should be noted that players who are not members of a slot player club or loyalty program of a gaming establishment (or who choose not to identify themselves as such) may still be identified as problem gamblers and their activities tracked and events dispatched to them over the course of different gambling sessions. For example, in one embodiment an image of a player may be captured and stored, the image serving to identify the player for future use. The second record in the database illustrates such a player. It should be noted that the player is further identified by a name; "Nora Smith." However, in other embodiments there may be no name associated with a player, or at least not initially. For example, when a player is first identified as a problem gambler, there may be no need to further identify the player by name. For example, a gaming establishment employee may be dispatched to approach a player without needing to know the name of the player (e.g., the gaming establishment employee may be directed to a particular gaming table 130 and a camera 56 or sensor in a seat 60 associated with the gaming table 130 may be used to confirm that the player playing at the time of the gaming establishment employee's approach is the same player who's actions triggered the gaming establishment employee to be dispatched). However, if the player continues to be identified as a problem gambler and/or the player's gambling behavior becomes more inappropriate (e.g., causing the player's problem gambler score to increase), further identifying information about the player (e.g., a name) may be desirable. Such information may be obtained, for example, by a gaming establishment employee who is dispatched to interact with the player and/or a dealer who solicits such information from the player.

Of course, other information besides that illustrated may be stored in a problem gambler database 178. For example, a problem gambler score may be stored in the problem gambler database 178 (e.g., in lieu of or in addition to being stored in a player database 176). In another example, notes regarding a gaming establishment employee's interactions with the problem gambler may be stored (e.g., how did player react). Such notes may be generated, as discussed herein on a mobile terminal 118, through a voice recording system, or the like. In another example, an indication of a success of an event that was dispatched with respect to the player may be stored. For example, an event may be considered successful if it caused the player to take a break from gambling, improve his problem gambling behavior (e.g., during the current play session and/or over a more extended period of time) and/or if a player expresses a positive reaction to the event (e.g., the player tells a gaming establishment employee "thank you, I didn't realize I was behaving in that manner").

Referring now to FIGS. 15A and 15B, illustrated therein is a tabular representation of a dispatched events database 180. The dispatched events database 180 may be stored in a memory of a device (e.g., memory 172 of site controller 52) in tabular form, or any other appropriate database form, as is well known in the art. The data stored therein may include a number of exemplary records or entries, including records R180-1 through R180-4, each defining an event that was dispatched upon determining that a player may require attention as a problem gambler or that a problem gambler is exhibiting problem gambling behavior. Those skilled in the art will understand that the dispatched events database 180 may include any number of entries.

The dispatched events database 180 may be utilized, for example, to track an event that has been dispatched (e.g., whether the event has been completed, the feedback, if any, regarding the event). The dispatched events database 180 may define fields for each of the entries or records. The fields may specify: (i) a dispatched event identifier 208 that (e.g., uniquely) identifies an event that has been dispatched; (ii) an event description 210 that described (e.g., in human and/or machine readable form) the corresponding event; (iii) a time of dispatch 212 that indicates a time at which the corresponding event was dispatched; (iv) a time of completion 214 that indicates a time at which the corresponding event was completed; (v) a player identifier 216 that identifies (e.g., uniquely) the player associated with the dispatched event (note that in some circumstances the identifier may be an image and in other circumstances no identifier may be needed or preferred); and (vi) a feedback field 218 that stores an indication of feedback (e.g., from a gaming establishment employee, player, and/or device associated with the event) regarding the player's response to the event.

Referring now to FIG. 16, illustrated therein is a tabular representation of an available event types database 182. The available event types database 182 may be stored in a memory of a device (e.g., memory 172 of site controller 52) in tabular form, or any other appropriate database form, as is well known in the art. The data stored therein may include a number of exemplary records or entries, including records R182-1 through R182-5, each defining a type of event that is available for dispatch. For example, the available event types database 182 may be accessed to determine an event to be dispatched with respect to a player upon determining that the player qualifies as a problem gambler.

It may be helpful to contrast an example use of the information stored in database 182 with an example use of the information stored in database 180. The information stored in the available event types database 182 may be accessed and a type of event selected (e.g., based on an output rule, as described below). A particular event or instance of an event may then be dispatched, the particular event or instance of event being based on the event type selected. A record may be opened in the dispatched events database 180, to track the dispatched event.

The available event types database 182 may define fields for each of the entries or records. The fields may specify: (i) an event type identifier 220 that identifies the type of event that is available for dispatch; (ii) an event type description 222 that describes the corresponding type of event (e.g., in machine and/or computer readable form); (iii) an event level 224 that indicates an intrusiveness or aggressiveness level of the type of event (e.g., in some embodiments, an intrusiveness level may be determined and a type of event selected based on this determination); (iv) an output rule 226 that indicates a rule based on which the corresponding type of event may be output. In some embodiments, the event level information and the problem gambler score information may be redundant, as the event level may be an indication of a corresponding problem gambler score or range of scores.

It should be noted that in the example embodiment illustrated in database 182, a type of event is output based on the satisfaction of a rule that specifies a range of problem gambler scores. That is, a problem gambler score may be determined for a player and an event type may be selected based on this score. In other embodiments, however, a type of event may be selected based on additional or different output rules. For example, a particular type of action or behavior on the part of a player may be associated with a particular type of event to be dispatched. In another example, the one or more events previously dispatched with respect to a player may be a factor in determining what type of event to select for a current dispatch.

It should further be noted that, in some embodiments, the event description field 222 may include a computer-readable file or pointer to a computer-readable file. For example, in some embodiments dispatching an event may comprise outputting a questionnaire or other information to a player via a device (e.g., a gaming device). In such embodiments, the event description field 222 may store the file comprising the questionnaire or other information.

Figure 17:
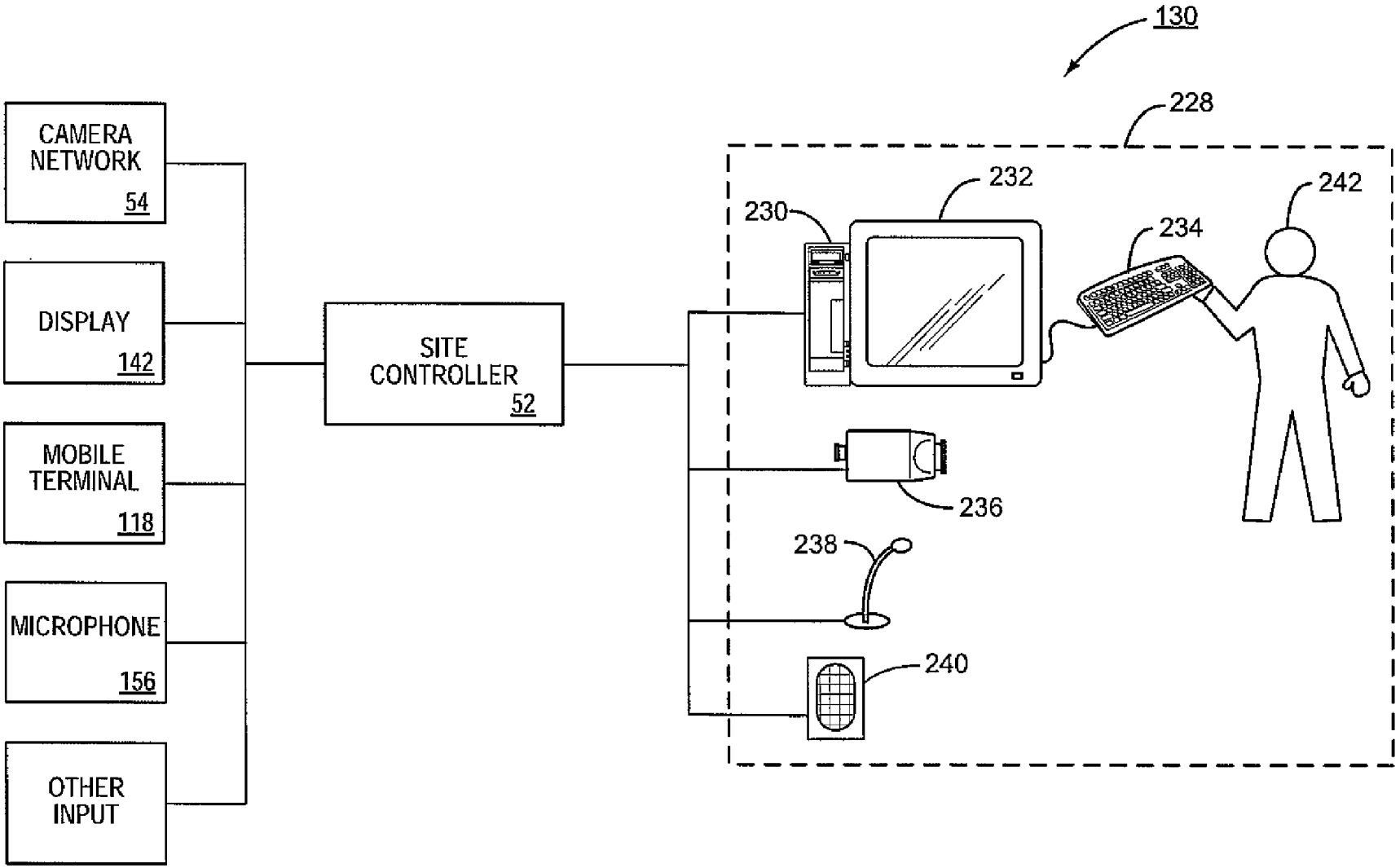
FIG. 17 illustrates a communication link to a remote party for use by embodiments of the present invention.

As yet another option for use with certain embodiments of the present invention comes from remote human input. Specifically, trained personnel may observe and interact with the players from a remote location as illustrated in FIG. 17. The various sensors including the camera network 54, mobile terminals 118, microphones 156, and other input as previously described may be passed to the site controller 52 and thence to a remote station 228. The remote station 228 may be positioned in the gaming establishment 10 (perhaps in the back office 50) or at a site removed from the gaming establishment 10 as needed or desired. The remote station 228 may include a computer 230 with a display 232 and a keyboard 234, a camera 236, a microphone 238, and speakers 240. An individual 242 may watch input come across from the sensors on the display 232, hear input on the speakers 240 and otherwise evaluate the information. The individual 242 may, in turn, provide feedback to gaming establishment personnel by typing on the keyboard 234, speaking into the microphone 238, or passing a video signal from the camera 236. The gaming establishment personnel may receive this feedback on the display 142 or from the mobile terminal 118 or the like as needed or desired. It is expected (although not strictly required) that the individual 242 is trained to recognize potential problem gambling behavior and is armed with embodiments of the present invention to help confirm or refute such an initial determination as well as help provide recommendations as to how to provide an appropriate event to assist individuals identified as problem gamblers.

In an exemplary embodiment, the remote station 228 may be merged into the site controller 52. In another embodiment, the remote station 228 is an entity that operates independently of the gaming establishment 10. For example, the remote station 228 could be operated by a non-profit problem gambling foundation, a state entity, or the like. In alternate embodiments, multiple remote stations 228 may be used, perhaps assigned to each gaming area within the pit 12 or by other division as needed or desired. While illustrated as a single communication link, it is possible that multiple communication links are used so as to accommodate the different input types.

At a high level, embodiments of the present invention detect potential problem gambling by tracking behavior of patrons. If a patron repeatedly or persistently performs a particular action or exhibits particular behavior, that may be indicative of problem gambling, and the patron may deserve closer scrutiny to determine if she is in fact a problem gambler. A player may be considered to have performed an action or engaged in the behavior repeatedly or persistently, for example, if the player performs the action or engages in the behavior a predetermined minimum number of times (or a predetermined minimum number of consecutive times) within a predetermined unit of time.

The sensors and the site controller 52, together with the personnel of the gaming establishment 10 are collectively referred to as a system herein, and this system performs the methods described herein. As described above, the actual decision making of the system is presumed to be vested in the site controller 52, but may be distributed amongst other elements of the system as needed or desired.

Figure 18:
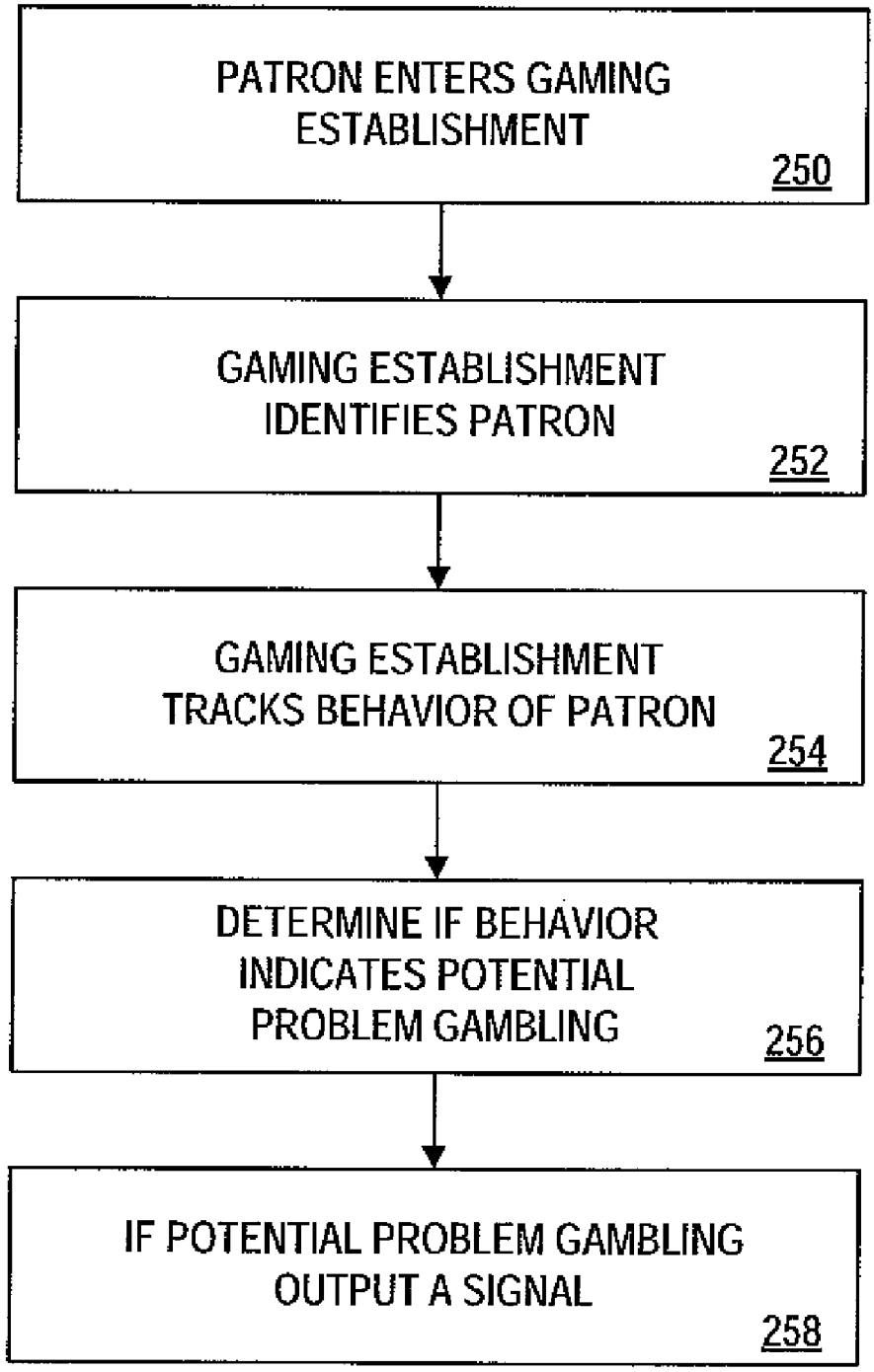
FIG. 18 illustrates a high level flow chart of a process consistent with one or more embodiments of the present invention.

Turning now to embodiments of the methodology of the present invention, reference is made to FIG. 18. To track a patron's behavior, the patron must be detectable by the system. Thus, in an exemplary embodiment, a patron enters a gaming establishment 10 (block 250). The gaming establishment 10 identifies the patron (block 252). This identification may be a self-provided identification, such as when a patron uses a credit card, a debit card, a player identifier card, a driver's license, a smart card, a biometric reader, or the like. Alternatively, the identification may be a bit more generic, such as a dealer 40 indicating to the voice recording system that there is a new patron in chair five of the blackjack table 21 or hitting a new player button on the table 130. Even more simply, the weight of the player on the pressure sensor 62 may indicate that a new player has arrived at a table 130; the wager area interrogator 158A may register a new wager in area 150; or the intelligent shoe 104 detects cards being dealt to a new player position 144. Thus passive and active techniques may register the presence of a new player. Other techniques to detect a new player are also possible. Upon identification, a profile is created for the patron. This profile may be in the player database 176 or other database as needed or desired. If the patron already has a profile therein, the information may be appended to the existing profile, otherwise a new profile may be created.

The gaming establishment 10 then tracks the behavior of the patron (block 254). The behavior is tracked through the various sensors described herein. Movement of the patron may be tracked by camera network 54, interrogators 88, chip purchases at the customer service booth 38, gaming establishment personnel reports through mobile terminals 118, and the like. Patron nonverbal behavior may be tracked by camera network 54, pressure sensors 62, thermal sensors 66, vibration sensors, and the like. Patron wagering activity may be tracked by tracking movement of chips and the like. In short, a broad spectrum of patron behavior is collected as part of the tracking. Various embodiments for tracking are disclosed in greater detail below.

The site controller 52 (or other decision making entity) determines if the tracked behavior indicates potential problem gambling (block 256). A number of different embodiments for determining potential problem gambling are disclosed in greater detail below.

If there is a determination that the behavior is indicative of potential problem gambling, a signal is output for use by the gaming establishment 10 (block 258). The type of signal and the use to which the signal is put vary by embodiment as further disclosed herein.

In some embodiments, the generation of a signal at block 258 may cause an event to be dispatched pursuant to the rules set forth in the event database 182. For example, some events may be considered minimally intrusive to the player or minimally aggressive with respect to curbing the player's inappropriate gambling behavior. Examples of such minimally intrusive or minimally aggressive events include, but are not limited to: (i) dispatching personnel to offer a gambler a ticket to a buffet, a free show, or other non-gambling event; (ii) dispatching personnel to engage the player in conversation not related to the player's problem gambler status; (iii) outputting an offer to the player for an event, buffet, promotion, etc. intended to distract the player from his gambling and/or to entice the player to leave the gaming device to perform another activity; and the like. Such minimally intrusive or minimally aggressive events are referred to herein as Level I events. Examples of more intrusive or more aggressive events that may be dispatched include, but are not limited to (i) dispatching personnel to approach the player and engage the player in conversation related to the player's gambling behavior (e.g., to verify or further determine whether the player is a problem gambler); (ii) outputting a questionnaire to the player, the questionnaire targeted at aiding the player in identifying himself as a problem gambler; (iii) outputting, or having personnel provide, information to the player about where to seek help for problem gambling activities; (iv) interrupting play by having the dealer 40 take a break; and/or (v) offering a loan at a usurious interest rate to see if the player accepts (such acceptance being a confirmation of problem gambling). Such more intrusive or more aggressive events are referred to herein as Level II events. Examples of even more intrusive or even more aggressive events that may be dispatched include, but are not limited to: (i) dispatching personnel to direct the player to stop playing; (ii) interrupting play in a manner that indicates to the player that play has been interrupted due to the player's inappropriate gambling behavior (e.g., the dealer 40 informs the player why he play has been interrupted); (iii) disqualifying the player from future wagering on certain games (e.g., games with a high volatility); and/or (iv) placing limitations on the player's ability to place wagers (e.g., wagers over a certain magnitude will not be accepted from the player and/or the player will not be allowed to wager more than $X per day or other unit of time). Such even more intrusive or aggressive events are referred to herein as Level III events.

Accordingly, in some embodiments, different levels of events may correspond to different levels or statuses of a problem gambler or problem gambler scores. For example, in one embodiment a status of a potential problem gambler status or low-level problem gambler status may correspond to Level I events. A potential problem gambler status or a low-level problem gambler status may correspond, for example, to a player who has exhibited some inappropriate gambling behavior but who may not necessarily have a severe gambling problem. In another example, a problem gambler status, a likely problem gambler status or a mid-level problem gambler status may correspond to Level II events. A problem gambler status, a likely problem gambler status, or a mid-level problem gambler status may correspond, for example, to a player who has exhibited more than a few or occasional inappropriate gambling behaviors, habits or actions but does not appear to have a severe gambling problem. An extreme problem gambler status or high-level problem gambler status may correspond to Level III events. An extreme or high-level problem gambler status may correspond, for example, to a gambler who has exhibited a multitude of inappropriate gambling behavior or inappropriate gambling behavior that is considered to be extreme and perhaps even dangerous to the player's lifestyle.

While not explicitly illustrated as a flow chart, the process of modifying a problem gambler score may be conceptualized as follows. An action of a player is determined. The action of the player may comprise, for example, an input provided by the player and/or a pattern of behavior exhibited by the player as detected by the various sensors of the system.

The action of the player is scored for a problem gambler score. For example, in some embodiments a number of points may correspond to each respective player action that may be an indication of a problem gambler. More points may correspond, for example, to actions that more clearly indicate a problem gambler.

The system determines whether a previous problem gambler score is associated with the player. For example, a player identifier may be determined for the player whose action was noted and the player identifier may be utilized to access the appropriate record in a player database 176 or a problem gambler database that is used to store such a problem gambler score, if any.

If no previous problem gambler score is associated with the player (e.g., the player has not previously performed any actions that would indicate the player is a problem gambler), an initial problem gambler score is created for the player. If, on the other hand, there is a previous score associated with the player, the score for new action is added to the previous score to determine a new problem gambler score for the player.

The new problem gambler score is compared to ranges or thresholds of problem gambler scores. For example, a table such as the one provided below may be used:

| Problem Gambler Score | Problem Gambler Status |
|---|---|
| 0-100 | Not a problem gambler |
| 101-150 | Potential problem gambler; low-level problem gambler |
| 151-200 | Problem gambler; mid-level problem gambler |
| <200 | Severe problem gambler |

Of course, in a simplified embodiment, there may not be different levels of a problem gambler and a table may not be necessary or desired. For example, the system may be programmed to determine that if the new problem gambler score is greater than X, the player is a potential problem gambler. Otherwise, the player may be considered to not be a problem gambler.

If it is determined whether the player is a potential problem gambler, the signal of block 258 may be generated, and an event dispatched, if appropriate. If the player is determined not to be a potential problem gambler, the problem gambler score is simply stored for future use.

Many sorts of player behavior may indicate problem gambling. To reflect this, embodiments of the present invention look at a wide spectrum of behavior and initially flag a patron as a potential problem gambler. Further evaluation is then conducted to elicit responses from the patron to assist in determining whether the patron is in fact a problem gambler or not. After confirmation that a patron is a problem gambler remedial steps may then be taken to help that player recover from the condition.

Figure 19:
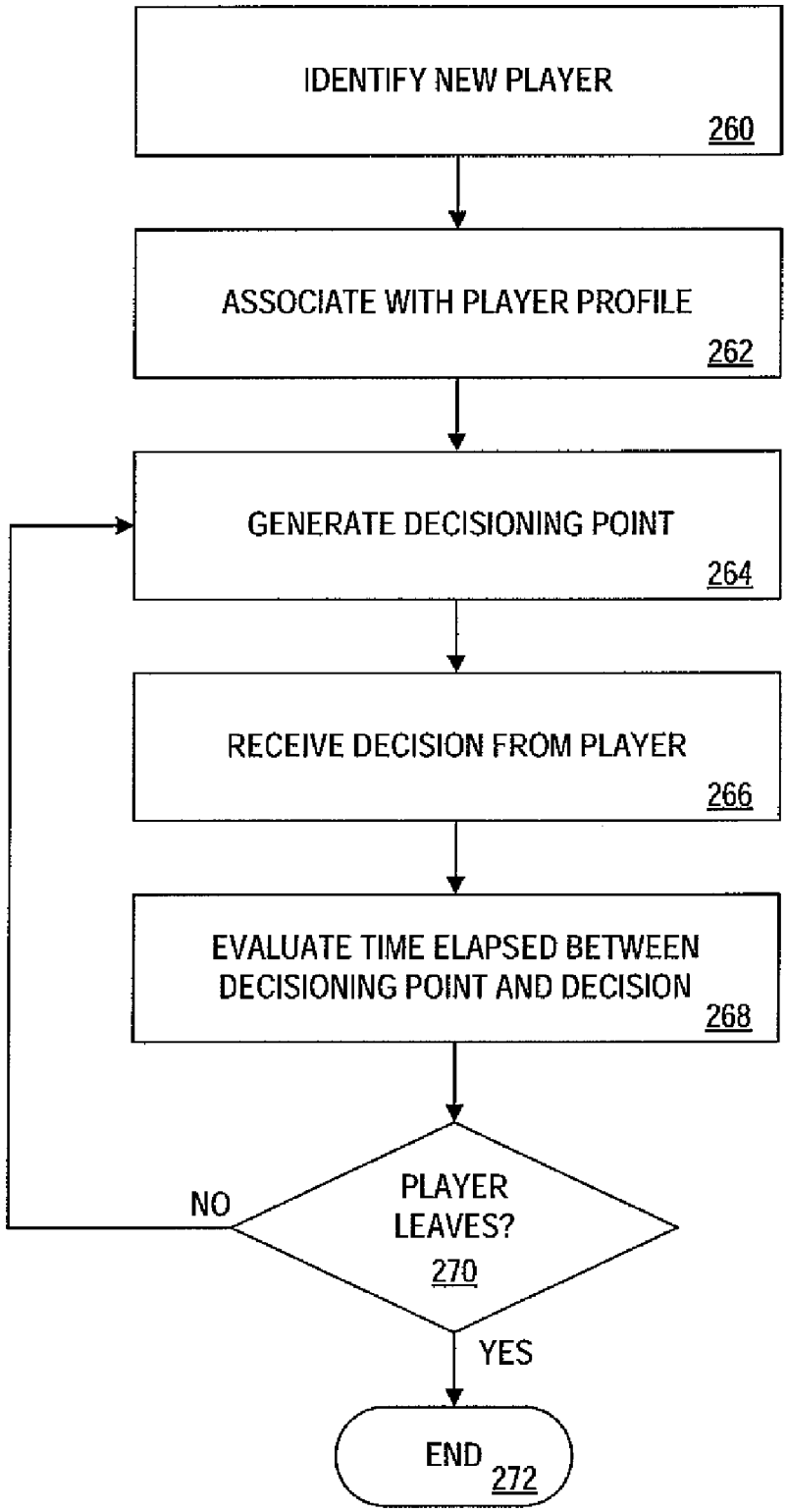
FIG. 19 illustrates a first embodiment of a process for tracking patron behavior.

A first embodiment of player behavior tracking is in tracking how fast a player plays tabletop games. If a player is playing at a speed, which indicates little or no thought is being used to contemplate decisions, then the player may be a problem gambler. An illustration of this embodiment is provided in FIG. 19. Initially, a player is identified (block 260) as they are presented with a tabletop game. This identification may be by the player using a player identification device (e.g., card or RFID item) with the player identifier mechanism 152 or any other technique alluded to elsewhere in this disclosure. By way of non-limiting example, the identification may be generated by the pressure sensor 62 detecting a player sitting down in a chair 60; the dealer 40 (or other personnel) may report to a voice recording system, which determines that a new player has begun; the dealer 40 (or other personnel) may press a button indicating a new player has joined a table 130; and/or camera 56 in the camera network 54 may also detect a new player.

The new player at the table is associated with a player profile (block 262). If the player has self-identified herself with a player identification device, then the player profile in the player database 176 is readily used. If the player has not previously identified herself, an image of the new player may be compared to other images within the player database 176 to see if an anonymous player already has a profile therein (e.g., the Nora Smith profile described above). If the player is not in the player database 176, a new (or temporary) profile may be created for the player. This profile may include an image or other identifying information as needed or desired so as to facilitate tracking of the new player.

Gaming commences or resumes, and the gaming establishment 10, in the form of its agent (i.e., the dealer 40 (or other personnel)), generates a decisioning point (block 264). Exemplary decisioning points include, but are not limited to: deciding to re-ante for a new game, taking a hit in blackjack, deciding whether to draw new cards in poker, deciding whether to raise or call, and the like. These decisioning points may be highlighted to the tracking system of the present invention by the dealer 40 (or other personnel) speaking into a voice recording system and denoting the time that the decisioning point was generated. Alternatively, a camera 56 or other sensor may record the generation of the decisioning point. For example, the dealer 40 (or other personnel) may press a button when he makes a call for new antes. Again, given the range of sensors available in the present system, numerous ways exist for tracking the generation of decisioning points. In an exemplary embodiment, the occurrence of the decisioning point is recorded in the player profile with a timestamp.

In response to the decisioning point, the gaming establishment 10 receives a decision from the player (block 266). Receiving the response may be inferred or explicit. For example, the player may state "I'm in" and place his ante in the appropriate wager spot 150. The system may infer reception of the decision through the placement of the ante or may use the player's affirmative representation of anteing as receiving the decision. Other decisions may be received directly or indirectly as well. For example, a decision to hit in blackjack is typically denoted by tapping one's cards. This decision may be seen by the dealer 40 and reported to the voice recording system. Likewise, a vibration sensor strategically placed may detect the tap and deliver the same to the site controller 52. A camera 56 may capture video of the tap and such may be detected on review by software associated with the site controller 52. Again, it is readily apparent that receiving the decision from the player may be effectuated directly or indirectly through any number of sensors available to the system. In an exemplary embodiment, receiving the decision is recorded in the player profile with a timestamp.

The system then evaluates the time elapsed between generation of the decisioning point and receiving the decision (block 268). In an exemplary embodiment, the timestamps in the player profile are compared and a time elapsed is calculated. In another embodiment, the dealer 40 (or other personnel) may observe that the player has been tapping the ante in the wager area waiting for the dealer 40 to clear cards and comment to this effect to the voice recording system. Such a comment may be disguised as friendly banter "Hey there champ, I am collecting cards as fast as I can, hold on, I'll get there" or similar folksy chatter. However, seeded into the banter may be a keyword (e.g., champ), which alerts the voice recording system that the player is anxiously awaiting the opportunity to re-ante. Another embodiment compares a time elapsed on a video signal. This may be done by comparing timestamps or counters on the video signal or even timing the time elapsed between generation of the decisioning point and receiving the decision. The system is monitoring the time between the generation of the decisioning point and the decision so that it may infer if the player is giving any contemplative thought or whether the player is playing mechanistically at a quick speed.

If the player leaves (block 270), the process ends (block 272). If however the player does not leave at block 270, the process repeats with further decisioning points being generated and receiving decisions from the player. If the player consistently is making decisions faster than an average (empirically determined by the gaming establishment 10 from other player profiles), then the player may potentially be a problem gambler and the player profile updated accordingly (e.g., by incrementing the problem gambler score). Alternatively, the rate of decision-making may be compared to a rate of decision-making historically evidenced by that player. If the rate has increased beyond a certain threshold, such behavior may be indicative of potentially problem gambling, and the problem gambler score may be incremented.

As a further variation on this embodiment, the system may monitor other input from other sensors and correlate the input to the decisioning making of the player. For example, a vibration sensor may detect whether a player is fidgeting in chair 60. Thermal sensors may detect whether the player's body temperature is heating up (perhaps in response to increased blood flow associated with anger). The dealer 40 may provide input about the player through the voice recording system. Cameras 56 or other optical sensors may detect facial expressions or other non-verbal movements by the player. All of these factors may be included in the problem gambler score if appropriate and needed or desired.

As a further variation on this embodiment, the system may monitor the current win/loss status of the player and correlate this win/loss status to the decision making. Normally, after a big loss, most players will pause before returning to the game. If the player re-antes quickly after a big loss (perhaps faster than her historical average), such behavior may be indicative of problem gambling. Likewise, some players may take a pause after a large win to bask in the warmth associated with the win or the adulation of the other players, but if the player re-antes quickly after a large win, this behavior may be indicative of problem gambling.

As still a further variation on this embodiment, the system may monitor the size of the wagers made by the player. This monitoring may be effectuated by the dealer 40 (or other personnel) reporting through the voice recording system, by detecting the size of the wager through an interrogator 158A and RFID chips 80, or other sensor disclosed herein. If the player is making progressively increasing wagers over a plurality of games (this behavior is sometimes referred to as chasing), such behavior is generally recognized as a sign of potentially problem gambling if sustained for an inordinate amount of time. Upon detecting chasing, the problem gambler score may be incremented in the player profile.

Figure 20:
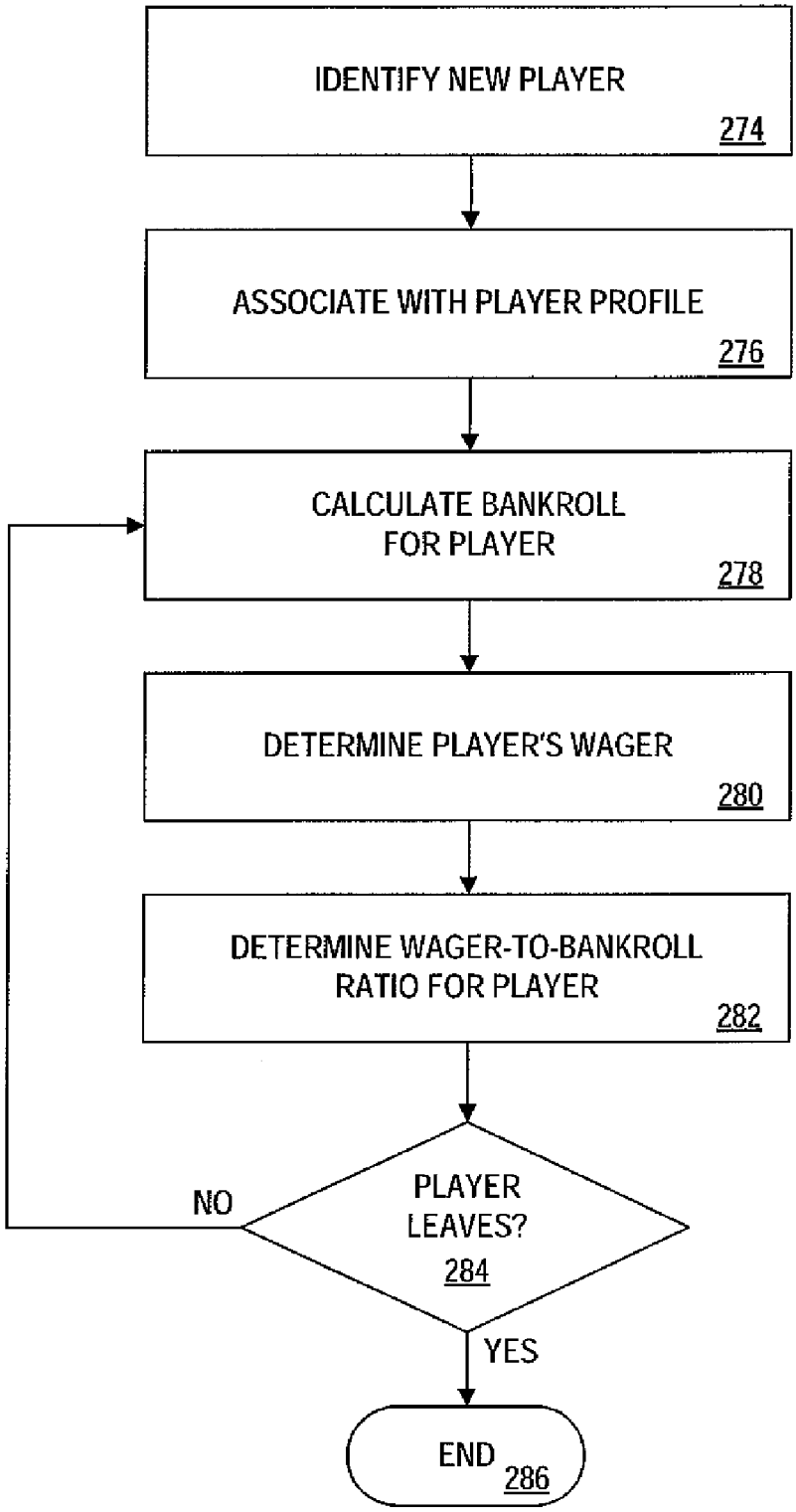
FIG. 20 illustrates a second embodiment of a process for tracking patron behavior.

A second embodiment of the methodology of the present invention is illustrated in FIG. 20. The second embodiment is designed to track a wager-to-bankroll ratio for a player. If the player consistently bets a large portion of her bankroll, the player may be compulsively betting or otherwise underfunding her gambling experience. Such compulsive betting and/or underfunding may be indicative of problem gambling. To detect this behavior, a new player is identified (block 274) as they are presented with a tabletop game. As noted above, detection of a new player may be effectuated through any number of means given the sensors of the system. The player is associated with a player profile (block 276). As noted above, there are myriad ways in which this association may be formed.

The system then calculates or otherwise determines a bankroll for the player (block 278). In a first embodiment, the bankroll may be determined by using an interrogator 158B to interrogate the player's bankroll area 146. If the player has placed her chips on the table 130 in the bankroll area 146, then the interrogator 158 receives responses from the RFID tags of the chips 80 in the bankroll area 146, and the system may calculate the player's bankroll based on these responses. In a second embodiment, the dealer 40 (or other personnel) may estimate the player's bankroll through visual inspection of what the player places on the table 130 and provide this information to the voice recording system. In a third embodiment, the player purchases chips from the dealer 40 and this transaction is recorded by the dealer using the chip tray interrogator, such as interrogator 96, 98 or 100. A third embodiment is similar in that the player may have purchased the chips at the customer service booth 38. This transaction is recorded by the cage tray interrogator 94 along with a record of which chips have been passed to that player. When a player places a chip from that transaction in the wager area 150, the chip is identified and the earlier transaction is referenced. Thus, the system infers the player's bankroll based on the identity of one chip and the record from the earlier transaction. Note that the player's inferred bankroll may evolve over time as a players wins and losses are attributed to the inferred bankroll. To the extent that the system may know that a particular chip has been awarded to a particular player as part of a won pot, if that chip appears at a later wager at a different table, the system may infer the same player has switched tables and has the bankroll she previously had. A fourth embodiment may employ a camera 56 along with edge and color detection to identify chips 80 within the bankroll area 146. A fifth embodiment uses a weight sensor in the bankroll area 146 to estimate a value of chips placed thereon based on their weight.

The system then determines the player's wager (block 280). Determining the player's wager may involve interrogating the wager area 150 with an interrogator 158A, receiving input from the dealer 40 (or other personnel) through the voice recording system, using a camera 56 to evaluate the value of the chips in a wager area 150, or the like.

The system then determines the player's wager-to-bankroll ratio (block 282). In an exemplary embodiment, the table controller 160 performs the calculations of this embodiment. In a second embodiment, the site controller 52 performs the calculations of this embodiment. In either event, the system compares the bankroll data and the wager data to see if the player is betting a large portion of her bankroll. If the player leaves (block 284), the process ends (block 286). If the player remains, the process repeats as indicated.

If the player is consistently betting a large portion of her bankroll, this fact may indicate that the player is gambling compulsively or is underfunding their gambling activity. In other words, the player is under-capitalized against the risk associated with the gambling she is undertaking, which may be indicative of an unreasonable expectation of success. This behavior may be indicative of compulsiveness. In either event, such behavior may be indicative of problem gambling and a notation to this effect may be made in the player profile.

Variations on this embodiment include taking input from auxiliary sensors, such as the pressure sensor 62, thermal sensors, cameras 56, vibration sensors, and the like and correlating this input with the wager-to-bankroll ratio. Another variation comprises determining if the player is making progressively larger wagers over the course of multiple games. As noted above, such chasing behavior may be indicative of problem gambling.

Figure 21:
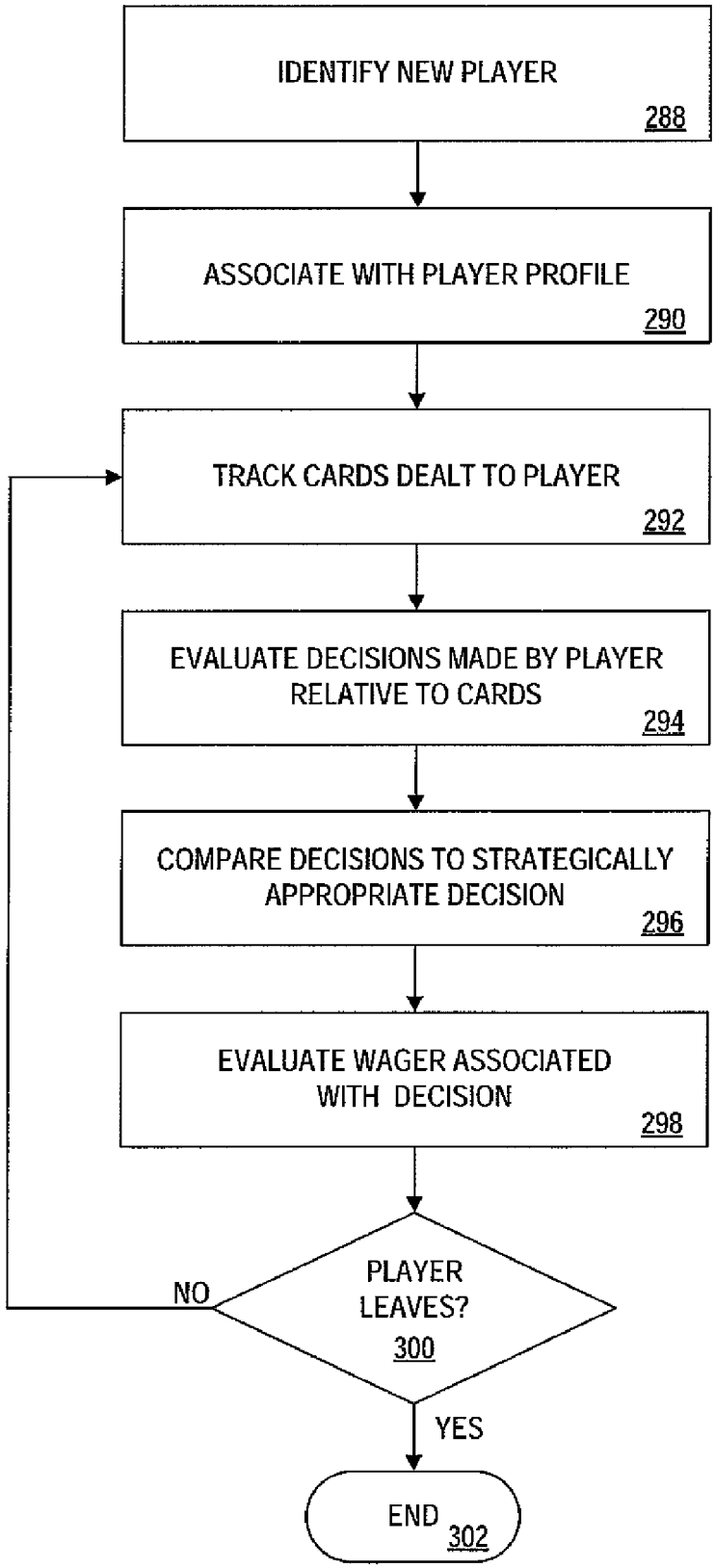
FIG. 21 illustrates a third embodiment of a process for tracking patron behavior.

A third embodiment is illustrated in FIG. 21 and relates to tracking the card strategy of players to determine if they might be problem gamblers. As usual, a new player is identified (block 288) as they are presented with a tabletop game. Details on this step are presented above. A profile is associated with the player (block 290). Again details on this step are presented above.

The system then tracks cards that are dealt to the player (block 292). In one embodiment, the cards are tracked by an intelligent shoe 104, which may provide suit and rank values to the system. In a second embodiment, the dealer 40 (or other personnel) may report the cards dealt to the player through the voice recording system (assuming the cards values are ascertainable, i.e. dealt face up). In a third embodiment, the cards may include RFID information and an interrogator reports the suit and rank of the card after interrogating the cards. Other mechanisms for tracking the cards dealt to a player are described in the previously incorporated patents and patent applications, and any may be used if needed or desired.

The system then evaluates a decision made by the player relative to the cards dealt to the player (block 294). A decision may be a discard decision, a fold decision, a call decision, a raise decision, a hit decision, a stand decision, a double-down decision, a split decision, and the like. The system may know of the decision from a dealer 40 (or other personnel) providing input to the voice recording system, a camera 56 capturing the decision, a microphone capturing the decision, tracking cards inserted into a discard shoe, tracking new cards dealt to the player, tracking electronic representations of cards, or other mechanism through which the decision may be inferred as needed or desired.

The decision is then compared to a strategically appropriate decision (block 296). That is, numerous guides exist that describe what decisions should be made in most games of chance. For example, the website www.wizardofodds.com has strategy guides for a wide variety of games as of this writing. Other strategy guides have been published as books such as *The Smarter Bet Guide to Blackjack* or *The Unofficial Guide to Casino Gambling*. The wizardofodds site especially indicates precisely what an appropriate decision a player should make given certain card distributions (e.g., always raise with a pair or higher in Caribbean Stud). Using one of these guides, a comparable guide, or other rule set that sets out strategically appropriate decisions based on possible situations, strategically appropriate decisions may be set and the player's decision compared to what the guide says. In this manner, the system can determine if the player is making a strategically correct decision. Some decisions may be marginal (e.g., raising in Caribbean Stud on A-K-Q-7-2 when the dealer has a six showing), in which case, that decision may not be deemed correct or incorrect.

In conjunction with knowing whether the player is making a strategically correct decision, the system may also evaluate a wager associated with the decision (block 298). The wager may be evaluated by interrogating a wager area 150 with an interrogator 158, using a camera 56, receiving input from the dealer 40 (or other personnel) through the voice recording system or other technique as needed or desired.

If the player leaves (block 300), the process ends (block 302). If the player continues to play at block 300, then the process repeats as indicated. Based on the information collected by the system, the system may evaluate if the player is making strategically correct wagering decisions based on the cards dealt to the player and the player's decision. For example, if the player discards a pair of aces in an effort to draw a royal flush, that may be characterized as a strategically incorrect decision, especially if the player makes a large wager before ascertaining whether the royal flush was in fact received. If the player is consistently making poor strategic decisions, this fact may be evidence of problem gambling.

Variations on this embodiment include varying the nature of the tracked item. For example, pai gow tiles, craps dice, roulette spins, and the like could all be tracked and compared to strategically appropriate decisions. For pai gow tiles, dice and roulette, it is probable that the sensor would be an RFID interrogator 158 rather than an intelligent shoe 104, but the present invention is not limited to such an embodiment. Another variation is tracking to see if the player makes increasingly large wagers to chase losses. Another variation is the use of ancillary inputs from other sensors including the vibration sensors, thermal sensors, and the like. Such inputs can be correlated to the decision making of the player to see if the player is exhibiting any unusual behavior while making the decision, before the decision, or after the decision.

Figure 22:
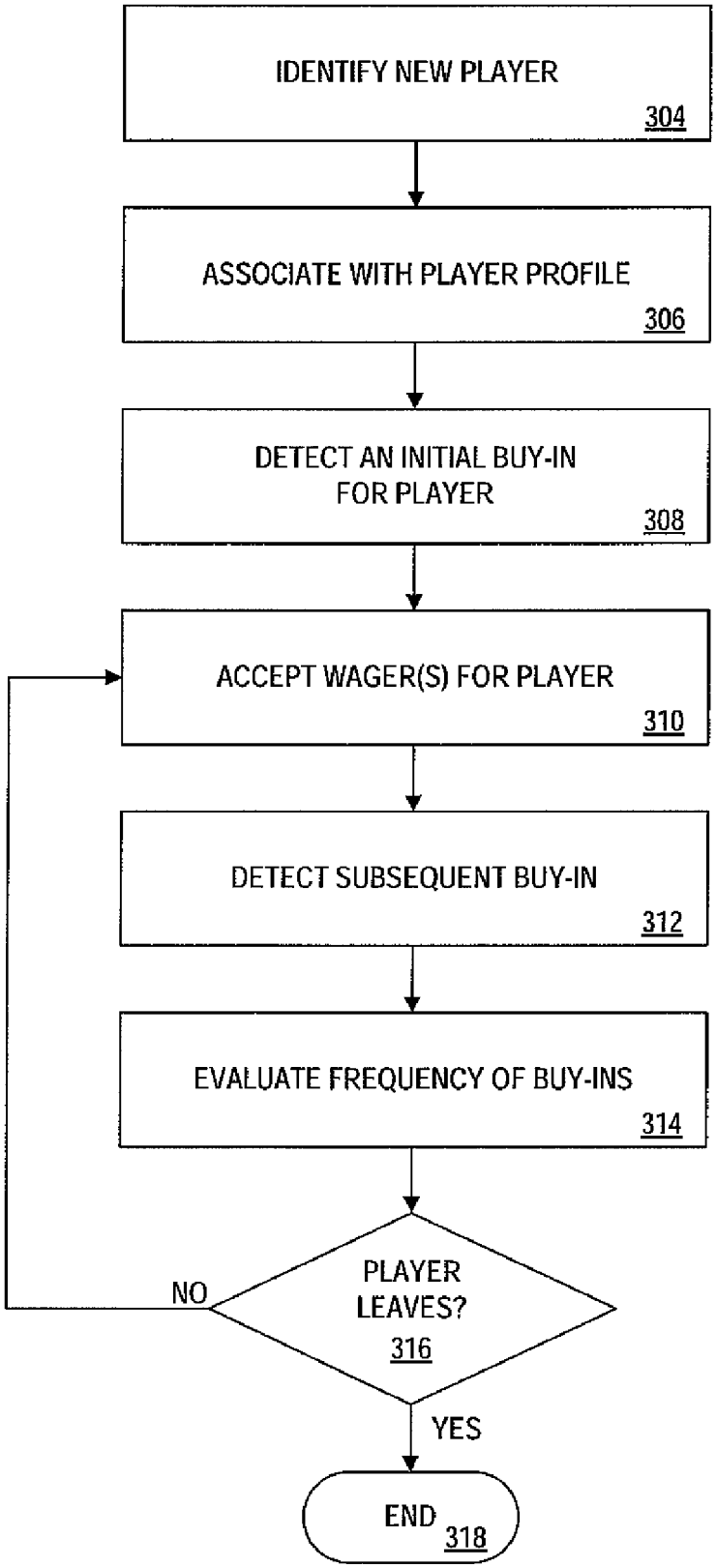
FIG. 22 illustrates a fourth embodiment of a process for tracking patron behavior.

A fourth embodiment of the present invention tracks the buy-in rate of a player to see if the player is adequately funding her gambling activity as illustrated in FIG. 22 or can afford to gamble at the rate that they are gambling. It has been observed that many problem gamblers believe that the next play is going to be the panacea that gets them "out of the hole" and "back on track". As a result of this belief, such gamblers only buy-in an amount sufficient to cover the next bet. Once they lose that bet, they are forced to buy-in again. Likewise, people that have frequent, low buy-ins may be making buy-ins at the low amounts because they cannot afford higher buy-ins. This embodiment tracks buy-in rates for players to look for people that have frequent buy-in rates.

As usual, a new player is identified (block 304) as they are presented with a tabletop game. Details on this step are presented above. A profile is associated with the player (block 306). Again details on this step are presented above.

The system detects an initial buy-in for the player (block 308). The buy-in may be reported by the dealer 40 (or other personnel) using the voice recording system, may be reflected in the appearance of chips 80 in a bankroll area 148, may be reflected in a change in chips 80 in a dealer tray 138 as detected by an interrogator 96, may be caught by camera 56, may be detected at the customer service booth 38 by cage interrogator 94 or other mechanism as needed or desired. In one embodiment, the total value of the buy-in is noted and stored in the player profile with a timestamp.

The game proceeds, with the dealer 40 (or other personnel) accepting one or more wagers from the player (block 310). The wagers may be tracked using the interrogator 158A and the RFID chips 80, cameras 56, voice recording system, or the like as needed or desired.

At some point, the player makes subsequent buy-in and this subsequent buy-in is detected (block 312). The subsequent buy-in may be detected through any of the mechanisms previously discussed. In an exemplary embodiment, the subsequent buy-in is stored in the player profile with a timestamp.

The system then evaluates the frequency of the buy-ins by the player (block 314). This evaluation may be made by comparing the timestamps, running a counter between buy-ins, or other technique as needed or desired. If the player leaves (block 316), the process ends (block 318). If the player continues to play, the process repeats as indicated.

If the frequency of the buy-ins is greater than a predetermined threshold, the player may be a problem gambler. A variation on this embodiment is comparing the player's buy-in rate to a historical buy-in rate for the player. Another variation is to see if the player is making increasingly larger buy-ins as this behavior may be indicative of chasing losses. Still another variation of this embodiment includes accepting input from auxiliary or ancillary sensors and correlating the player's behavior observed by such ancillary or auxiliary sensors with the player's buy-in behavior. Another variation is looking at the wagers to the buy-in amounts. If a player buys one hundred coins and wagers one hundred coins three times in a row compared to buying one hundred fifty and making three wagers of fifty and then buying one hundred fifty and making three wagers of fifty, the former may be problem gambling, whereas the latter may be deemed less likely to be so.

Figure 23:
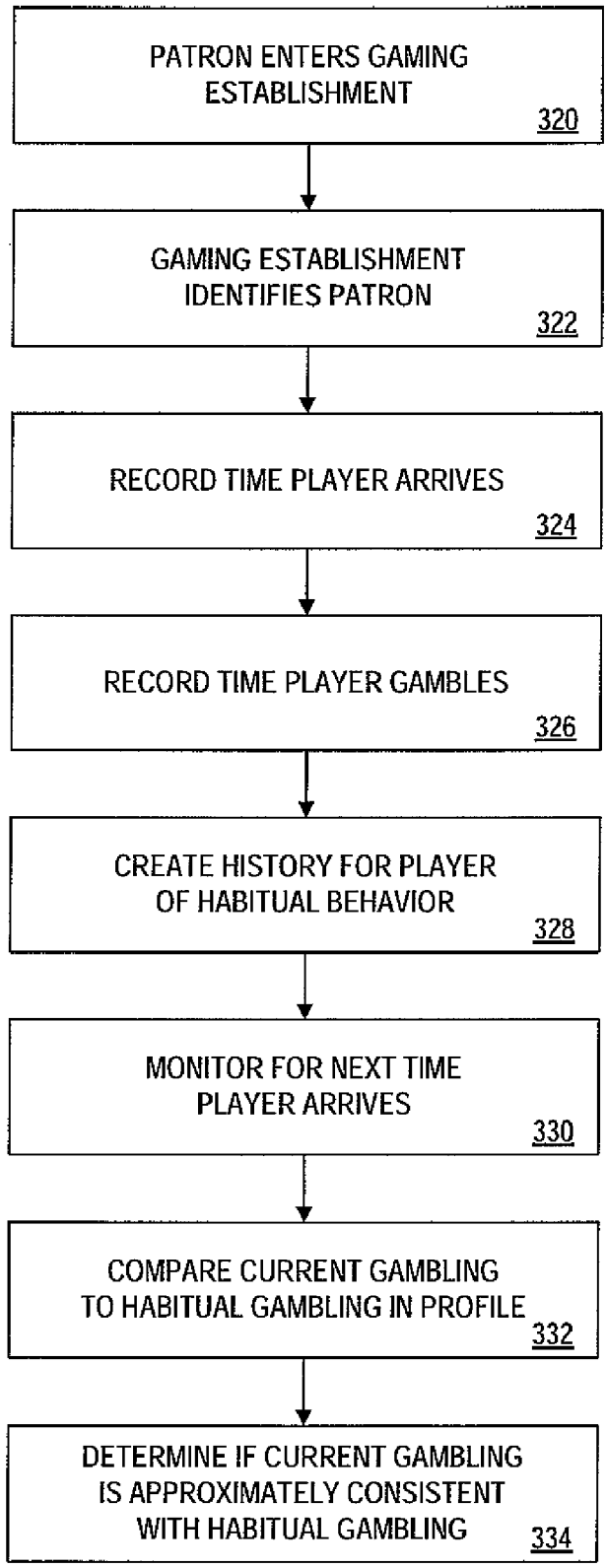
FIG. 23 illustrates a fifth embodiment of a process for tracking patron behavior.

A fifth embodiment of the present invention involves tracking the behavior of a player to ascertain whether the player is exhibiting aberrational behavior. This embodiment is illustrated in FIG. 23. A new player is identified (block 320) as they begin gambling. The player may be detected by insertion of a player identifier card, using a credit card to make an initial purchase of chips, optically detecting the player, biometrically detecting the player, receiving a report from personnel about the player's presence, receiving a signal from the ATM 30, receiving a signal from the pressure sensor 62, the dealer 40 pressing a new player button, the dealer 40 reporting through the voice recording system, a shuffle request or the like. A profile is associated with the player (block 322). Again details on this step are presented above.

In particular, the time that the player arrives at the gaming establishment 10 is recorded (block 324). Additionally, as an optional step, the time that the player spends gambling is recorded (block 326). For example, the player's record in player database 176 may be updated to show that on Monday, Jan. 2, 2006, the player played from 2 until 6 PM. This process will repeat until a history of the player's behavior can be created (block 328). Thus, if the player arrives on Monday, Jan. 9, 2006 and plays from 1:30 until 6 PM; Monday, Jan. 15, 2006 and plays from 3 to 6:15 PM; and Monday January 22 and plays from 2 until 6:30 PM, the player profile may reflect that this player habitually plays Monday afternoons from around 2 until around 6. Statistical data may be compiled once enough data points are collected including a mean, median, variance, and standard deviation to show how tight the data is.

The system then monitors the player's next arrival time (block 330) and compares this new data point to the habitual gambling data in the profile (block 332). Based on this comparison, the system may determine if the current gambling activity is approximately consistent with the habitual gambling data in the profile (block 334). During the comparison, the standard deviation or other statistical data may become particularly relevant in establishing whether an event is approximately consistent with the habitual gambling data. That is, for example, if the new data is more than three standard deviations away from the habitual data, this new behavior may be indicative of problem gambling. Other thresholds could be set as needed or desired. In an exemplary embodiment, the looser the historical data, the looser the threshold for the player. However, if a player is habitually punctual and plays for a set amount of time each session, then sudden variations in the frequency of appearance, length of gaming session, day of gaming session, or the like may all be indicative of problem gambling.

A variation on this embodiment is tracking the player by block of days. For example, if someone vacations at the Hard Rock Hotel and Casino for four days every June and September and then suddenly shows up for one day sessions in July, August, and October, this change in behavior may indicate problem gambling. Thus, tracking by blocks of days is also within the scope of the present invention.

Another variation on this embodiment combines the behavior tracking pattern with the historical buy-in behavior of the patron. If, for example, the player routinely purchases one hundred dollars in chips on each of her visits, but then shows up and purchases five thousand dollars in chips, this behavior may be aberrational and potentially indicative of problem gambling.

Figure 24:
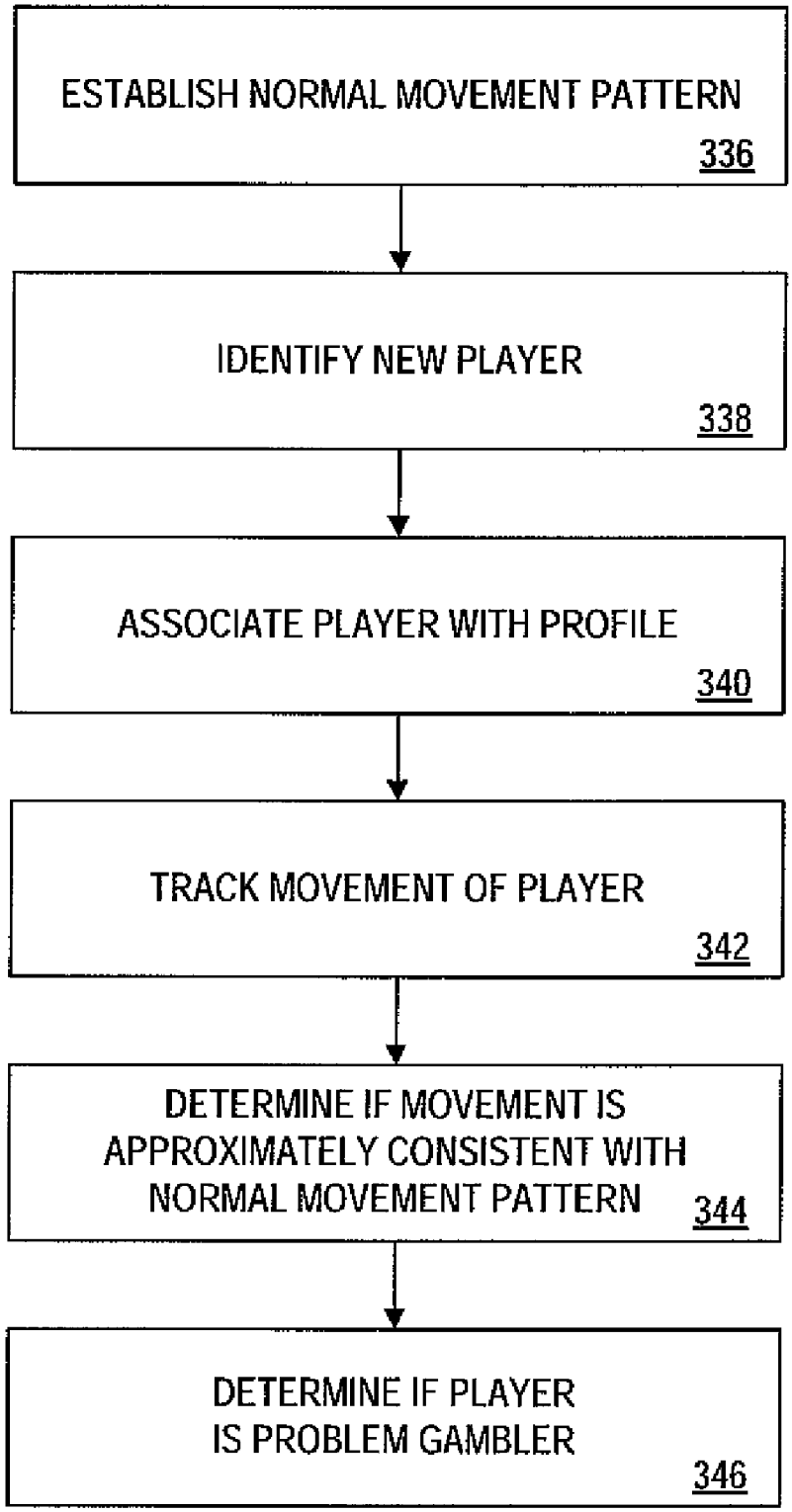
FIG. 24 illustrates a sixth embodiment of a process for tracking patron behavior.

A sixth embodiment of the present invention tracks the movement of a player within a gaming establishment 10 and compares this movement to normal movement patterns to detect potential problem gambling. This embodiment is illustrated in FIG. 24. Initially, a normal movement pattern for the gaming establishment 10 is established (block 336). The normal movement pattern may be determined empirically by tracking selected patrons movements and averaging this movement. In one embodiment, camera network 54 is used to track a patron's movement. In another embodiment, the interrogators 88 interrogate an RFID player identifier device. This movement may be plotted on a diagram or map of the gaming establishment 10. As more patrons are tracked in this manner, certain movement patterns may emerge for a hypothetical typical patron. Statistical values may be determined to ascertain how "tight" the data is. The looser the data, the larger the standard deviation. The tighter the data, the smaller the standard deviation. For example, if every patron goes to the ATM 30 first, then to the customer service booth 38 and then to a game, this movement pattern may have a small standard deviation (at least until the paths diverge as patrons go to their favorite games). Conversely, if the flow is more chaotic, then a large standard deviation may be generated.

After creation of the "normal" movement pattern, a new player is identified (block 338) as they enter the gaming establishment 10. Details on this step are presented above. A profile is associated with the player (block 340). Again details on this step are presented above.

The system then tracks the movement of the player (block 342). Such movement may be tracked by camera network 54, interrogators 88, personnel reports into the voice recording system, detection of credit card activity, detection of ATM activity, and the like.

The movement of the player is compared to the "normal" movement to determine if the movement is approximately consistent with the normal movement pattern (block 344). Again, the threshold for how close is "approximately consistent" may be set by the gaming establishment and may be a function of how tight the data is from the empirical testing.

Based on the movement patterns, the system may determine if the player is a problem gambler (block 346). That is, if the movement falls outside of a normal range of movement, that may be indicative of problem gambling an alert generated.

Variations on this embodiment include directing personnel such as a floor man 44 to inspect the player visually to see if further information may be ascertained about the player. This customer assistance personnel may be dispatched even if the player's movement is not indicative of problem gambling. For example, if a player is circling a bank 20 of automated machines, the player may be looking for someone or a particular type of machine. In such a case, the customer assistance personnel may help the player locate a particular machine or player to build goodwill for the gaming establishment 10. Alternatively, certain movements may suggest looking for a restroom or ATM. The customer assistance personnel may be dispatched to the player and inquire if they may be of assistance or provide directions. Once the nature of the of the player's search is revealed, the personnel may assist the player by directing the player to a restroom, ATM or the like. The customer assistance personnel may then report through mobile terminal 118 or other device that the person is not a problem gambler, just one that needed a restroom or other report as appropriate.

Note that some movement may normally be indicative of problem gambling, but contextually is not. For example, excessive pacing may be indicative of a potential problem gambler. However, pacing in front of the keno monitor 36 as the last few numbers are displayed may be normal. Thus, location and time of movement may be relevant to the movement analysis and can be factored into what is "normal" movement.

While not explicitly illustrated, in numerous embodiments, reference has been made to ancillary or auxiliary input. In some embodiments, this ancillary or auxiliary input may be important enough to support a finding of potential problem gambling. For example, angry or anxious behavior as detected by cameras 56, reported by personnel through mobile terminal 118 or the voice recording system may show the anxious or angry behavior. Likewise, vibration sensors may detect nervous tapping. Thermal sensors may detect fluctuations in body temperature indicative of increased blood flow such as an anxious patron might exhibit. All of these behaviors individually or collectively with another embodiment may support a finding of potential problem gambling. Another factor potentially indicative of problem gambling is borrowing activity of a patron. If a patron borrows heavily and immediately wagers all of the borrowed funds, such may be akin to a high buy-in rate described above. If the player manifests other addictions or levels of impairment (e.g., alcohol is detected based on personnel observations, drink orders, or the like), this may contribute to the problem gambler score.

Figure 25:
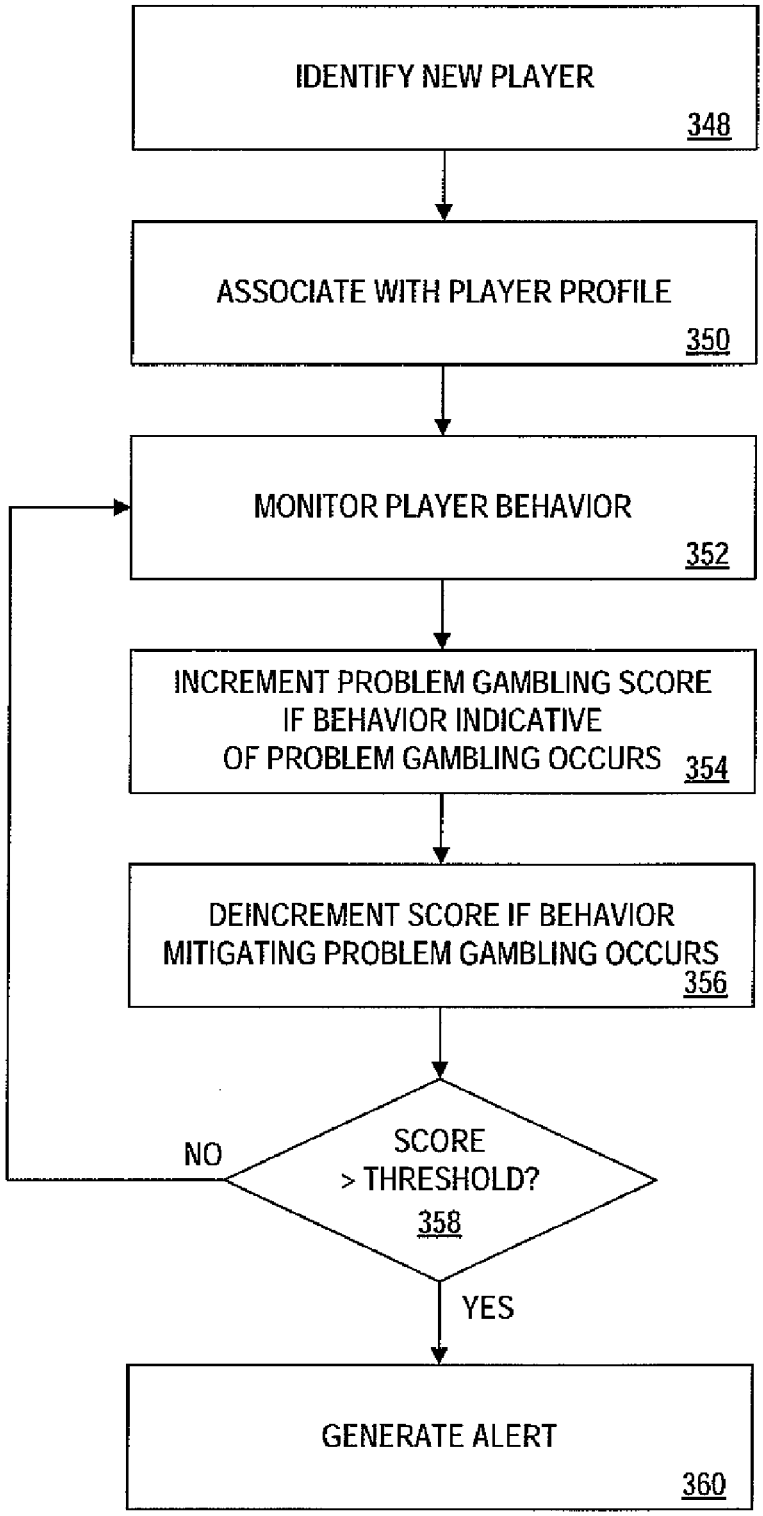
FIG. 25 illustrates an embodiment of the present invention where player behavior mitigates against a finding of problem gambling.

While all of the above embodiments focus on detecting potential problem gambling, there may be mitigating factors that weigh against a finding that a player is a problem gambler. There are a number of ways in which such factors may be addressed. An exemplary embodiment is illustrated in FIG. 25. As usual, a new player is identified (block 348) as they are presented with a tabletop game. Details on this step are presented above. A profile is associated with the player (block 350). Again details on this step are presented above.

The system monitors the player's behavior (block 352). In the player profile, a problem gambler score (such as in field 198) is incremented if behavior indicative of problem gambling occurs (block 354). Thus, if the gaming establishment uses any of the embodiments described above, or if they have identified other behavior indicative of problem gambling, and such behavior is detected, the problem gambler score may be incremented. A further example of how different inputs may be weighted for incrementing the problem gambler score is explained with reference to FIG. 27. Conversely, the problem gambler score is decremented if behavior mitigating problem gambling is detected (block 356). Exemplary behaviors that may mitigate include the player making strategically appropriate decisions, the player withdrawing a bet, the player reducing her wager, the player reducing her wager after losing, the player slowing the rate of play, the player taking a break from gambling, and the like.

If the problem gambling score has not exceeded a threshold (block 358), monitoring continues. If however, the problem gambling score does exceed a threshold an alert may be generated (block 360). If an alert is generated, an event may also occur as described above and in the parent application.

Variations on this embodiment include generating an opportunity for a mitigating factor to arise. For example, on receiving an alert, a floor man 44 may be dispatched to observe the player to have further input as to whether a player is potentially a problem gambler. The floor man 44 may still not be sure and may offer the player a coupon for a buffet in the restaurant 14 or offer the player a drink if they take a break and chat. If the player rebuffs the offer, then the player's score may increase. If however, the player accepts good naturedly, then the score may be decremented as having been mitigated. Dealers 40 or other gaming establishment personnel may also create the opportunity for mitigation as needed or desired, perhaps through suggesting that the player slow down or take a break.

Figure 26:
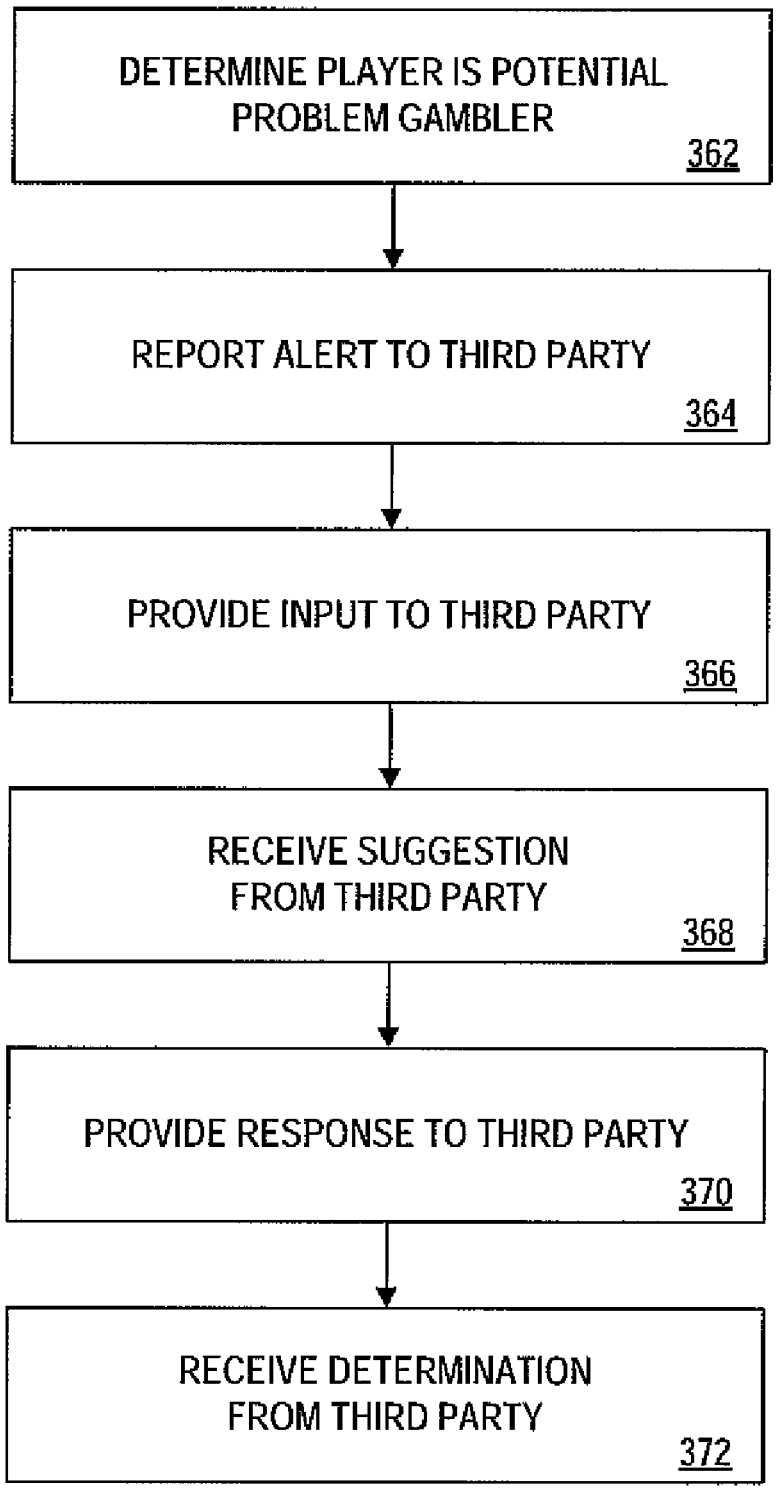
FIG. 26 illustrates an embodiment of the present invention that uses a remote station for assistance in determining if a player is a problem gambler.

While the above embodiment alludes to the fact that additional input may be solicited if the problem gambler score exceeds a threshold, the additional input need not come from floor personnel. Rather, the input may come from the remote station 228, back office 50, or other personnel (including floor personnel if needed or desired). This embodiment is illustrated in FIG. 26. The system determines that a player is a potential problem gambler (block 362) such as, for example, by the player's problem gambler score exceeding a threshold. The alert is generated and reported to a third party (block 364). The system then provides the input from the sensors relating to the player to the third party (block 366). That is, as illustrated in FIG. 17, the remote station 228 is provided camera feeds, sensor feeds, and the like relating to the player. The third party may also have access to the player profile in player database 176.

The third party may evaluate the inputs and make a suggestion (block 368) as to how the gaming establishment 10 should interact with the potential problem gambler. For example, the third party may suggest that the dealer 40 slow down the rate at which the dealer 40 is dealing so that the third party may observe the player's reaction. Other suggestions might include, but are not limited to: requesting the dealer 40 shuffle the deck, requesting the dealer 40 purposefully misdeal so as to void a particular hand, request that personnel offer the player a coupon for a buffet, show, request that personnel offer the player a benefit in exchange for filling out a survey, request that the dealer ask the player if the dealer is dealing too fast or too slow and the like. The purpose of these suggestions is to create interactions with the player in question in an effort to elicit a reaction from the player. Reactions to such suggestions may be helpful in gauging the player's propensity for problem gambling. For example, if the player immediately accepts an offer to see a show, enjoy a discounted meal, or perform other non-gambling activity, such behavior indicates that the player is probably not a problem gambler.

The types of suggestions or the manner in which the suggestions are provided to the dealers 40 may be limited to alleviate any concerns about the gaming establishment 10 improperly using knowledge gleaned from the inputs. Normally such matters are not of great concern. For example, in Blackjack, the gaming establishment has strict rules about when it must stand or hit and knowledge of a player's hand is irrelevant to those decisions. Likewise, in Caribbean Stud, there are no decisions to be made by the gaming establishment 10. However, if the dealer 40 is not just dealing cards in a poker game, but also using the gaming establishment 10's money to play poker against the players, then it is readily apparent that knowledge of the opposing player's hands might influence the dealer's decisions. To combat accusations of cheating in such instances, the remote station 228 may be prohibited from speaking directly to the dealer and may only send pre-scripted messages to the dealer such as "ask him if he would like to take a break" or "slow down the deal" or "wait a minute before making your bet" and the like. In this manner, the dealer 40 is not able to capitalize on the knowledge afforded to the gaming establishment 10 by the various sensors described herein.

The player's response is provided to the third party (block 370) through the sensors including audio and visual feeds from cameras 56 and microphones. For example, the third party may observe if the player's temperature goes up, if the player becomes verbally abusive, if the player becomes physically agitated and the like. Based on the observed response, the third party may make a determination that a player is or is not a problem gambler. The system receives this determination from the third party (block 372) and may generate the next event according to the schedule or take other action as needed or desired.

As is readily apparent, the methodologies of the various embodiments may be extended across multiple tables within the pit 12. For example, if a player starts play at one table and creates an initial problem gambling score, then leaves (perhaps to purchase more chips) and begins play at a second table, use of the player profile in the player database 176 allows the player's new activity to be tacked onto the initial activity. Likewise, the embodiments may be mixed and matched with each other and with inputs from the ancillary or auxiliary sensors. While a few of the embodiments specifically refer to correlating the auxiliary or ancillary sensors to the input that is the focus of the embodiment, it should be appreciated that all the embodiments may do so. For example, a drop in the player's temperature may be indicative of a mitigating factor in certain instances.

Figure 27:
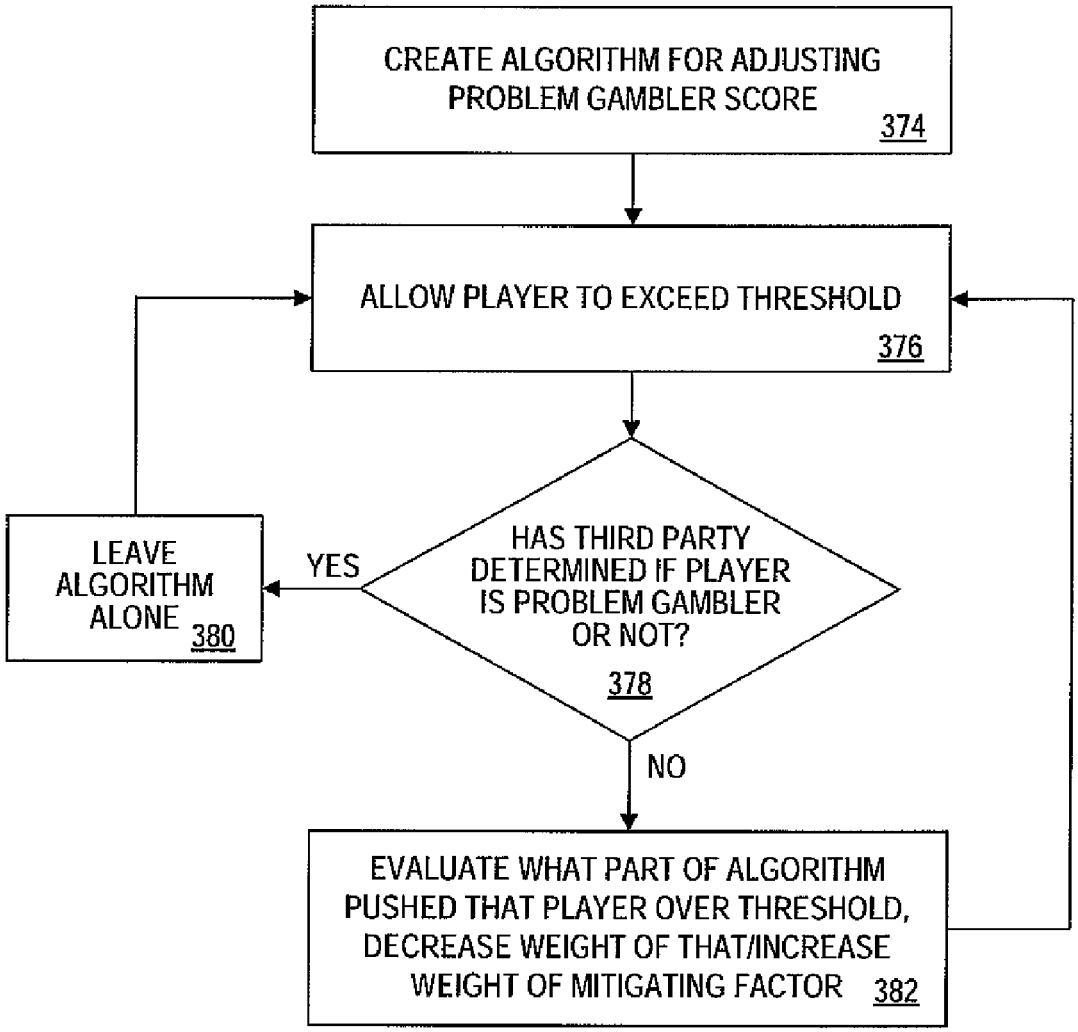
FIG. 27 illustrates an embodiment of a method to change how potential problem gamblers are identified.

An embodiment of the present invention tries to accommodate the various inputs and adjust them so that proper decisions are made with respect to players. This process is illustrated in FIG. 27. Initially an algorithm is created that accepts the various inputs from the various sensors in use by the system (block 374). For example, each input may initially be assigned a coefficient of one and summed to arrive at a problem gambling score. The system allows a player to exceed the threshold (block 376) necessary to invoke the third party review of FIG. 26. The third party determines if the player is or is not a problem gambler (block 378). If the player is a problem gambler, the algorithm works appropriately and the algorithm is unchanged (block 380) as the process repeats.

If however, the third party determines that the player is not a problem gambler, the algorithm is evaluated to determine what factor pushed the player over the threshold. The coefficient for that factor in the algorithm may be reduced or, if the third party indicates that it should not be reduced, the weight of a mitigating factor may be increased by increasing its coefficient. In short, the algorithm is adjusted so that the player's problem gambler score is not over the threshold (block 382) and the process repeats. This method may be performed iteratively until the third party routinely confirms that the player who has exceeded the potential problem gambler threshold is a problem gambler. Alternatively, a neural net or other form of rudimentary learning filter may be trained to adjust the algorithm based on the third party input. Other techniques of adjusting the weights on the various inputs may also be used if needed or desired (e.g., using human and neural net inputs).

Adjusting the weights of the algorithm may have the added benefit of customizing the problem gambling detection to particular locales. For example, frequent buy-ins may be indicative of problem gambling in the United States, but less so in the Philippines. The algorithm in the United States gives it more weight, but the algorithm in the Philippines gives it less weight. These differences may be the result of cultural differences, or other factors, but the present system has the flexibility to accommodate such variations.

Using the system and methodologies explicated above, it is readily apparent that a variety of different indicators of problem gambling exist, and embodiments of the present invention capture and help address such behavior. A few examples of implementations are provided herein.

Example 1

A player sits down at roulette table 22 and buys twenty dollars worth of chips 80 from the croupier 42. The player wagers poorly and buys and additional twenty dollars worth of chips 80 from the croupier 42 ten times within a half hour period (for a total buy-in of two hundred twenty dollars). Embodiments of the present invention track this rate of buy-in and generates an alert that the player is a potential problem gambler because the high frequency of chip purchases within such a short period of time demonstrates the player's potentially unrealistic expectations of the amount required to fund the session. Alternatively, the croupier through the voice recording system may provide sufficient mitigating information to lower the player's problem gambling score such that an alert is not generated. For example, if the player says "this $20 is John's and he said bet on black . . . oops, John lost. This $20 is Mary's and she said bet on 34 . . . oops, Mary lost" etc. while referring to a handwritten collection of notes then the croupier 34 may jokingly chide the player about his friends' poor luck while making notations in the voice recording system that show that these repetitive buy-ins should not be attributed to a single patron.

Example 2

A player sits down at blackjack table 21. Within five seconds of losing each hand, the player places a new wager in wager area 150. Most players typically repost a bet within a short period of time following a losing hand. However, after a series of consecutive losses, many players will be more hesitant and slower to repost a bet. The system will detect the continued pace of reanteing by the player and increment the problem gambler score.

Example 3

Over the course of a half hour, the player plays many hands of baccarat. Occasionally, the player sits out a few hands by not placing a wager. Because compulsive gamblers generally lack the willpower to resist the opportunity to place a wager, sitting out a few hands weighs against the subject player's problem gambling score.

Example 4

In some embodiments, the behavior is compared to a rule set instead of a particular mathematical algorithm. For example, a rule may provide IF player makes four bets in three minutes AND each bet was accompanied by a buy-in AND all bet outcomes result in player loss AND a vibration sensor associated with the player is triggered within the same three minutes THEN increment the problem gambler score for the player.

In still another embodiment, instead of sending an alert to a remote station 228 or back office 50 (or in addition to the same), an alert may be sent to a party indicated within a player profile, such as a spouse, friend or counselor. This third party, on receiving the alert may contact the player to discuss the situation with the player.

In still another embodiment, the alert may be sent to the player's mobile terminal (such as a cell phone) in addition to or in place of the alert to the remote station 228 or back office 50. This sort of reminder may help the player realize that they are gambling in a potentially problematic way. In such an alert, images, video, or audible alerts may be appropriate, including a pre-recorded message that reminds the player of a particularly horrible gambling experience and compares this past experience to the present behavior. Such images or audio may be selected by a therapist in conjunction with the player, by a therapist alone, be of the player or other gamblers, come from a state or non-profit agency, refer to a counseling agency (Gamblers Anonymous), be a current recording of the player from the camera network 54 or the like as needed or desired.

While embodiments of the present invention are designed to facilitate detection of problem gambling in a relatively unobtrusive manner, it is possible that certain patrons may find the various sensors of the various embodiments to be an invasion of their privacy. Those patrons may always choose not to patronize gaming establishments that include problem gambling detection capabilities. Alternatively, the gaming establishment 10 may include an opt-out provision. When a player signs up for a player tracking mechanism, the player may make an indication that the player tracking information gleaned by embodiments of the present invention is only to be used for fraud detection and comp programs. If players refuse to patronize a player tracking program, the gaming establishment 10 may offer the player other opt-out mechanisms, such as by filling out a request that is kept on file with an image or other identifying information about the patron. Alternatively, the patron may tell the dealer 40, croupier 42 or other gaming establishment personnel that they do not wished to be tracked for problem gambling. Then, the personnel may disable sensors associated with the chair 60, player position 144, and the like for that patron. Note that in some embodiments, only certain sensors may be disabled, the location to which the information is reported may be controlled, or the use to which the information is put may be controlled. For example, in one embodiment, the information from the sensors may still be used for detecting fraud or card counting perpetrated by the patron, but not used in a problem gambling algorithm. Opt-out information may be stored as needed or desired to comply with regulatory mandates.

Another variation on such an opt-out provision is that the gaming establishment 10 may automatically opt-out certain classes of individuals such as foreign nationals while not providing opt-out options for local nationals. In this manner, the gaming establishment 10 may protect its local population from the perils of problem gambling. Detection of whether a player is in such a protected class or unprotected class may be made with reference to the player database 176 or other technique as needed or desired. While this embodiment is perhaps unpalatable to certain advocates of civil liberties, the present invention is capable of such distinctions. Even for individuals automatically opted-out, the gaming establishment 10 may still track the patrons for fraud or other objectionable behavior.

As another variation, the system described herein may accept additional inputs from sources other than the sensors already described. For example, other patrons may provide indications of problem gambling. These indications may optionally be anonymous and include a potential problem gambler's name, photograph, or other identifying information from which the potential problem gambler may be identified. Using this variation, a relative or concerned person (including gaming establishment personnel who observe or know the individual) may report an individual as a problem gambler and the gaming establishment 10 may then monitor that person more closely or may give that person an initial problem gambler score higher than someone about whom the establishment has no prior information (e.g., the person starts with a score of fifty instead of zero). Such reporting may be incentivized through comp points or employee rewards, although care may be taken to prevent abuse of the system.

Another source of information is the surveys alluded to above or the application to join a player tracking system. Such applications and surveys may include questions that help track genetic or environmental factors that may contribute to problem gambling. For example, the application or survey may query whether any relatives have been problem gamblers and other demographic information to ascertain if there is a pattern in that information associated with problem gambling.

Rules of Interpretation

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this patent application) nor the Abstract (set forth at the end of this patent application) is to be taken as limiting in any way as the scope of the disclosed invention(s).

The terms patron and player are frequently used interchangeably. If a contrary intention is desired, such will be made clear in the text surrounding the usage in question.

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining and the like.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" means any one or more microprocessors, CPU devices, computing devices, microcontrollers, digital signal processors, or like devices.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

Some embodiments can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer. Communications over the Internet may be through a website maintained by a computer on a remote server or over an online data network including commercial online service providers, bulletin board systems, and the like. IN yet other embodiments, the devices may communicate with one another and/or a computer over RF, cable TV, satellite links, and the like.

Devices in communication with each other need not be continually transmitting to each other. On the contrary, such computers and devices need only transmit to each other as necessary, and may actually refrain from exchanging data most of the time.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present disclosure.

What is claimed is:

1. A method comprising:

on a computer, establishing a player profile with information relating to gambling habits for a player, wherein the gambling habits relate to habitual gambling times;

monitoring a current gambling time for the player;

first determining if the current gambling time is approximately consistent with the habitual gambling times in the player profile; and second determining if the player is potentially a problem gambler based on the first determining.

2. The method of claim 1 wherein establishing the player profile comprises monitoring the player to determine a habitual day of the week in which the player habitually gambles.

3. The method of claim 1 wherein establishing the player profile comprises monitoring the player to determine a habitual block of hours in which the player habitually gambles.

4. The method of claim 1 wherein establishing the player profile comprises monitoring the player to determine a habitual number of days in which the player habitually gambles.

5. The method of claim 1 wherein establishing the player profile comprises monitoring the player to determine a habitual frequency with which the player habitually gambles.

6. The method of claim 1 wherein monitoring a current gambling time comprises monitoring using a technique selected from a group consisting of: detecting insertion of a player card; detecting use of a credit card, optically detecting the player, receiving a report from gaming establishment personnel about a player's presence, receiving a signal from a weight sensor, receiving input from a dealer, receiving input from an automatic shuffle device, receiving a signal from a biometric reader, and receiving a signal from an automatic teller machine.

* * * * *